US007449073B2

(12) United States Patent
Lin et al.

(10) Patent No.: US 7,449,073 B2
(45) Date of Patent: Nov. 11, 2008

(54) 2000 SERIES ALLOYS WITH ENHANCED DAMAGE TOLERANCE PERFORMANCE FOR AEROSPACE APPLICATIONS

(75) Inventors: Jen C. Lin, Export, PA (US); John M. Newman, Export, PA (US); Paul E. Magnusen, Pittsburgh, PA (US); Gary H. Bray, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 141 days.

(21) Appl. No.: 11/220,424

(22) Filed: Sep. 7, 2005

(65) Prior Publication Data

US 2008/0029187 A1 Feb. 7, 2008

Related U.S. Application Data

(63) Continuation-in-part of application No. 10/893,003, filed on Jul. 15, 2004.

(51) Int. Cl.
*C22C 21/12* (2006.01)

(52) U.S. Cl. ..... 148/417; 420/533; 420/539

(58) Field of Classification Search ..... 148/417, 148/418; 420/532, 533, 539
See application file for complete search history.

(56) References Cited

U.S. PATENT DOCUMENTS 3,925,067 A 12/1975 Sperry et al.
5,213,639 A 5/1993 Colvin et al.
5,376,192 A * 12/1994 Cassada, III ..... 148/415
5,512,112 A 4/1996 Cassada, III
5,593,516 A 1/1997 Cassada, III
5,630,889 A 5/1997 Karabin
5,652,063 A 7/1997 Karabin
5,665,306 A 9/1997 Karabin
5,800,927 A 9/1998 Karabin (Continued)

FOREIGN PATENT DOCUMENTS

GB 1320271 6/1973

(Continued)

OTHER PUBLICATIONS

J. Schijve, "The significance of flight-simulation fatigue tests," Delft University Report (LR-466), Jun. 1985.

(Continued)

*Primary Examiner*—Roy King
*Assistant Examiner*—Janelle Morillo
(74) *Attorney, Agent, or Firm*—Greenberg Traurig LLP; Peter J. Borghetti

(57) ABSTRACT

The invention provides a 2000 series aluminum alloy having enhanced damage tolerance, the alloy consisting essentially of about 3.0-4.0 wt % copper; about 0.4-1.1 wt % magnesium; up to about 0.8 wt % silver; up to about 1.0 wt % Zn; up to about 0.25 wt % Zr; up to about 0.9 wt % Mn; up to about 0.5 wt % Fe; and up to about 0.5 wt % Si, the balance substantially aluminum, incidental impurities and elements, said copper and magnesium present in a ratio of about 3.6-5 parts copper to about 1 part magnesium. The alloy is suitable for use in wrought or cast products including those used in aerospace applications, particularly sheet or plate structural members, extrusions and forgings, and provides an improved combination of strength and damage tolerance.

24 Claims, 14 Drawing Sheets

U.S. PATENT DOCUMENTS

| | | | | |
|---|---|---|---|---|
| 5,863,359 | A | 1/1999 | Karabin et al. | |
| 5,865,914 | A | 2/1999 | Karabin | |
| 5,879,475 | A | 3/1999 | Karabin | |
| 6,368,427 | B1 | 4/2002 | Sigworth | |
| 6,444,058 | B1 | 9/2002 | Liu et al. | |
| 2004/0071586 | A1 * | 4/2004 | Rioja et al. | 420/532 |

FOREIGN PATENT DOCUMENTS

| | | | |
|---|---|---|---|
| JP | 03107440 | | 5/1991 |
| WO | WO 2004003244 | A1 * | 1/2004 |
| WO | 2006019946 | | 2/2006 |

OTHER PUBLICATIONS

"After Concorde: Evaluation of an Al-Cu-Mg-Ag Alloy for Use in the Proposed European SST", Polmear I. J. et al, Materials Science Forum, Aedermannsdorf, CH, vol. 217-222, pp. 1759-1764, XPOO9003900, ISSN: 0255-5476.

* cited by examiner

2000 SERIES ALLOYS WITH ENHANCED DAMAGE TOLERANCE PERFORMANCE FOR AEROSPACE APPLICATIONS

FIELD OF THE INVENTION

The present application is a continuation-in-part of U.S. application Ser. No. 10/893,003 filed Jul. 15, 2004, the complete disclosure of which is incorporated herein by reference.

This invention relates to an Al—Cu—Mg—Ag-alloy having improved damage tolerance, suitable for aerospace and other demanding applications. The alloy has very low levels of iron and silicon, and a low copper to magnesium ratio.

BACKGROUND INFORMATION

In commercial jet aircraft applications, a key structural requirement for lower wing and fuselage applications is a high level of damage tolerance as measured by fatigue crack growth (FCG), and fracture toughness. Current generation materials are taken from the Al—Cu 2XXX family, typically of the 2×24 type. These alloys are usually used in a T3X temper and inherently have moderate strength with high fracture toughness and good FCG resistance. Typically, when the 2×24 alloys are artificially aged to a T8 temper, where strength is increased, there is degradation in toughness and/or FCG performance.

Damage tolerance is a combination of fracture toughness and FCG resistance. As strength increases there is a concurrent decrease in fracture toughness, and maintaining high toughness with increased strength is a desirable attribute of any new alloy product. FCG performance is often measured using two common loading configurations: 1) constant amplitude (CA), and 2) under spectrum or variable loading. The latter is intended to better represent the loading expected in service. Details on flight simulated loading FCG tests are described in J. Schijve, "*The significance of flight-simulation fatigue tests*", Delft University Report (LR-466), June 1985. Constant amplitude FCG tests are run using a stress range defined by the R ratio, i.e., minimum/maximum stress. Crack growth rates are measured as a function of a stress intensity range (ΔK). Under spectrum loading, crack growth is again measured, but this time is reported over a number of "flights." Loading is such that it simulates typical takeoff, in flight, and landing loads for each flight, and this is repeated to represent typical lifetime loadings seen for a given part of the aircraft structure. The spectrum FCG tests are a more representative measure of an alloy's performance as they simulate actual aircraft operation. There are a number of generic spectrum loading configurations and also aircraft-specific spectrum which are dependent on aircraft design philosophy and also aircraft size. Smaller, single aisle aircraft are expected to have a higher number of takeoff/landing cycles than large, wide-bodied aircraft that make fewer but longer flights.

Under spectrum loading, an increase in yield strength will often reduce the amount of plasticity-induced crack closure (which retards crack propagation) and will typically result in lower lives. An example has been the performance of a recently developed High Damage Tolerant alloy (designated herein as 2×24HDT) which exhibits a superior spectrum life performance in the lower yield strength T351 temper versus the higher strength T39 temper. Aircraft designers would ideally like to have alloys that possess higher static properties (tensile strength) with the same or higher level of damage tolerance as that seen in the 2×24-T3 temper products.

U.S. Pat. No. 5,652,063 discloses an aluminum alloy composition having Al—Cu—Mg—Ag, in which the Cu—Mg ratio is in the range of about 5-9, with silicon and iron levels up to about 0.1 wt % each. The composition of the '063 patent provides adequate strength, but unexceptional fracture toughness and resistance to fatigue crack growth.

U.S. Pat. No. 5,376,192 also discloses an Al—Cu—Mg—Ag aluminum alloy, having a Cu—Mg ratio of between about 2.3-25, and much higher levels of Fe and Si, on the order of up to about 0.3 and 0.25, respectively.

There remains a need for alloy compositions having adequate strength in combination with enhanced damage tolerance, including fracture toughness and improved resistance to fatigue crack growth, especially under spectrum loading.

SUMMARY OF THE INVENTION

The present invention solves the above need by providing a new alloy showing excellent strength with equal or better toughness and improved FCG resistance, particularly under spectrum loading, as compared with prior art compositions and registered alloys such as 2524-T3 for sheet (fuselage) and 2024-T351/2×24HDT-T351/2324-T39 for plate (lower wing). As used herein, the term "enhanced damage tolerance" refers to these improved properties.

Accordingly, the present invention provides an aluminum-based alloy having enhanced damage tolerance consisting essentially of about 3.0-4.0 wt % copper; about 0.4-1.1 wt % magnesium; up to about 0.8 wt % silver; up to about 1.0 wt % Zn; up to about 0.25 wt % Zr; up to about 0.9 wt % Mn; up to about 0.5 wt % Fe; and up to about 0.5 wt % Si; the balance substantially aluminum, incidental impurities and elements, said copper and magnesium present in a ratio of about 3.6-5 parts copper to about 1 part magnesium. Preferably, the aluminum-based alloy is substantially vanadium free. The Cu:Mg ratio is maintained at about 3.6-5 parts copper to 1 part magnesium, more preferably 4.0-4.5 parts copper to 1 part magnesium. While not wishing to be bound by any theory, it is thought that this ratio imparts the desired properties in the products made from the alloy composition of the present invention.

In an additional aspect, the invention provides a wrought or cast product made from an aluminum-based alloy consisting essentially of about 3.0-4.0 wt % copper; about 0.4-1.1 wt % magnesium; up to about 0.8 wt % silver; up to about 1.0 wt % Zn; up to about 0.25 wt % Zr; up to about 0.9 wt % Mn; up to about 0.5 wt % Fe; and up to about 0.5 wt % Si; the balance substantially aluminum, incidental impurities and elements, said copper and magnesium present in a ratio of about 3.6-5 parts copper to about 1 part magnesium. Preferably, the copper and magnesium are present in a ratio of about 4-4.5 parts copper to about 1 part magnesium. Also preferably, the wrought or cast product made from the aluminum-based alloy may be substantially vanadium free.

In an additional aspect, the invention provides a sheet, plate, extruded or forged aerospace aluminum alloy product having a valuable combination of strength, toughness and corrosion resistance, consisting essentially of copper from about 3.0 to about 4.0 wt. %, magnesium from about 0.4 to about 1.1 wt. %, manganese 0.20 to 0.40 wt. %, iron up to about 0.5 wt. %, silicon up to about 0.5 wt. %, silver up to 0.8 wt. %, zinc up to 0.40 wt. %, and up to 0.1 wt. % of a grain refiner, the remainder aluminum and incidental elements and impurities. In this aspect, the combined weight percent of Ag and Zn is at least 0.3 wt. % and said Cu and Mg are present in a ratio of about 3.6-5 parts Cu to about 1 part Mg. The alloy product is particularly useful in wing applications, including panels and stringers, and in fuselage applications such as skin, stringers, and in fuselage frames. The product may also be useful in thick structures such as ribs and spars.

In an additional aspect, the alloy products of the invention possess at least one valuable and unexpected mechanical properties including: toughness (UPE) in the T-L orientation (measured by the Kahn tear test using ASTM B871) at least 60% higher than AA 2524HDT-T3 or T8 similarly tested; average high load transfer joint fatigue life about 60% greater than 2×24HDT in terms of average fatigue life (in cycles); as well as a mode of corrosion type that shifts from inter-granular (in 2×24HDT) to pitting as measured by ASTM G110. In an additional aspect of the invention, the alloy products possess one or more mechanical properties or combinations of mechanical properties including: toughness as measured by the Kahn tear test using ASTM B871 of at least about 40% higher than AA2524 similarly tested and having about the same UTS and TYS; toughness as measured by the Kahn tear test using ASTM B871 of at least about 20% higher than AA2524 similarly tested and at least about a 10% increase in UTS and TYS relative to AA2524; an average high load transfer joint fatigue life at least about 60% greater than 2×24HDT in terms of average fatigue life (in cycles); and a change in corrosion property type from inter-granular to pitting as measured by ASTM G110.

It is an object of the present invention, therefore, to provide an aluminum alloy composition having improved combinations of strength, fracture toughness and resistance to fatigue.

It is an additional object of the present invention to provide wrought or cast aluminum alloy products having improved combinations of strength, fracture toughness and resistance to fatigue.

It is an object of the present invention to provide an aluminum alloy composition having improved combinations of strength, fracture toughness and resistance to fatigue, the alloy having a low Cu:Mg ratio.

These and other objects of the present invention will become more readily apparent from the following figures, detailed description and appended claims.

BRIEF DESCRIPTION OF THE DRAWINGS

The invention is further illustrated by the following drawings in which.

DETAILED DESCRIPTION OF PREFERRED EMBODIMENTS

Figure 1:
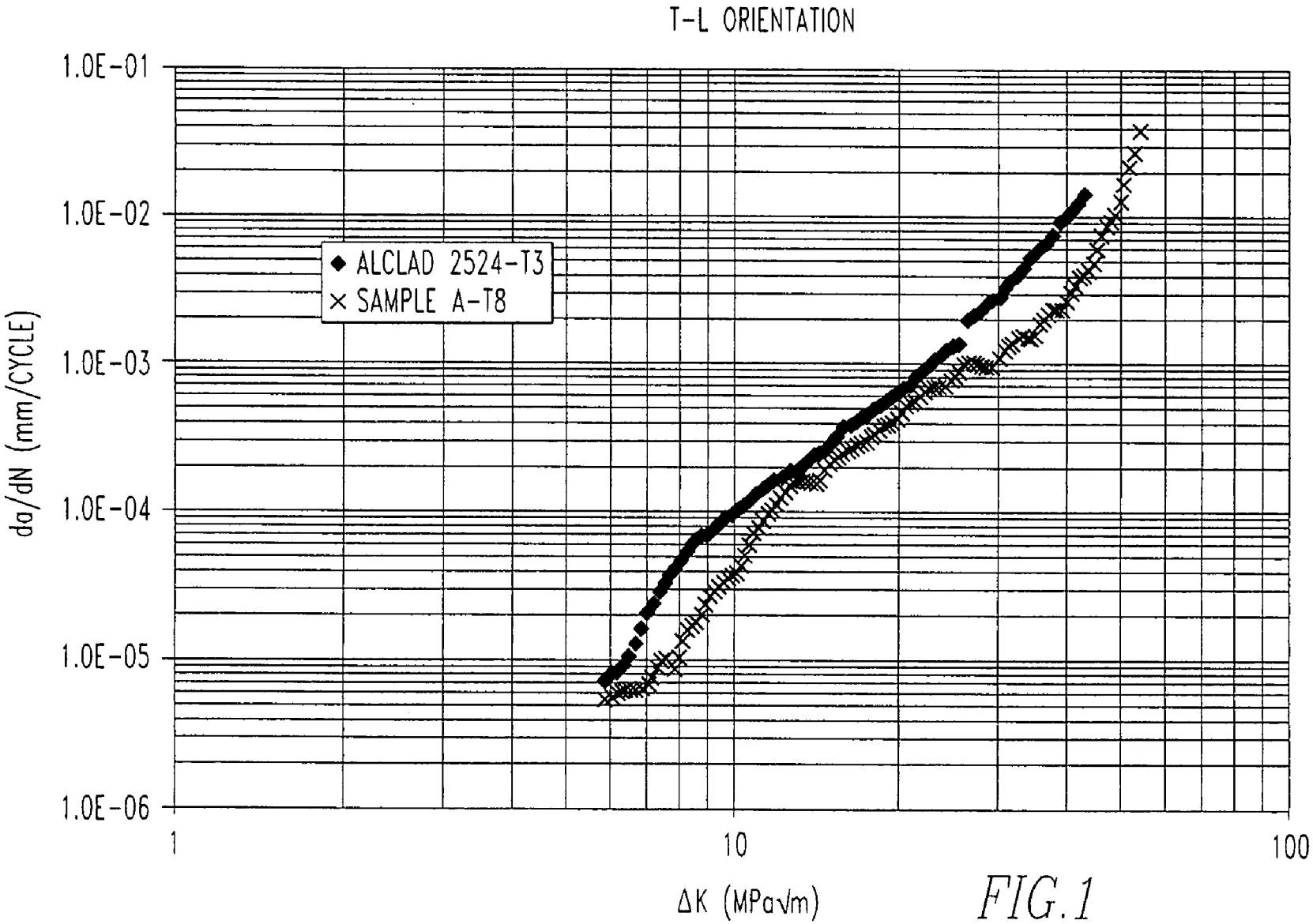
FIG. 1 is a graph showing constant amplitude FCG data for 2524-T3 and Sample A-T8 sheet. Tests were conducted in the T-L orientation with R ratio equals 0.1.

Definitions: For the description of alloy compositions that follow, all references to percentages are by weight percent (wt %) unless otherwise indicated. When referring to a minimum (for instance for strength or toughness) or to a maximum (for instance for fatigue crack growth rate), these refer to a level at which specifications for materials can be written or a level at which a material can be guaranteed or a level that an airframe builder (subject to a safety factor) can rely on in design. In some cases, it can have a statistical basis, e.g., 99% of the product conforms or is expected to conform to 95% confidence using standard statistical methods.

When referring to any numerical range of values herein, such ranges are understood to include each and every number and/or fraction between the stated range minimum and maximum. A range of about 3.0-4.0 wt % copper, for example, would expressly include all intermediate values of about 3.1, 3.12, 3.2, 3.24, 3.5, all the way up to and including 3.61, 3.62, 3.63 and 4.0 wt % Cu. The same applies to all other elemental ranges set forth below, such as the Cu:Mg ratio of between about 3.6 and 5.

The present invention provides an aluminum-based alloy having enhanced damage tolerance consisting essentially of about 3.0-4.0 wt % copper; about 0.4-1.1 wt % magnesium; up to about 0.8 wt % silver; up to about 1.0 wt % Zn; up to about 0.25 wt % Zr; up to about 0.9 wt % Mn; up to about 0.5 wt % Fe; and up to about 0.5 wt % Si; the balance substantially aluminum, incidental impurities and elements, said copper and magnesium present in a ratio of about 3.6-5 parts copper to about 1 part magnesium. Preferably, the copper and magnesium are present in a ratio of about 4-4.5 parts copper to about 1 part magnesium.

As used herein, the term "substantially-free" means having no significant amount of that component purposefully added to the composition to import a certain characteristic to that alloy, it being understood that trace amounts of incidental elements and/or impurities may sometimes find their way into a desired end product. For example, a substantially vanadium-free alloy should contain less than about 0.1% V, or more preferably less than about 0.05% V due to contamination from incidental additives or through contact with certain processing and/or holding equipment. Many of the preferred embodiments of this invention are substantially vanadium-free, though others need not be so constrained.

The aluminum-based alloy of the present invention optionally further comprises a grain refiner. The grain refiner can be titanium, a titanium compound, or a ceramic compound. When present, the grain refiner is typically present in an amount ranging up to about 0.1 wt %, more preferably about 0.01-0.05 wt %. With respect to titanium, all of the weight percentages for a titanium grain refiner, as used herein, refer to the amount of titanium or the amount containing titanium, in the case of titanium compounds, as would be understood by one skilled in the art. Titanium is used during the DC casting operation to modify and control the as-cast grain size and shape, and can be added directly into the furnace or as grain refiner rod. In the case of grain refiner rod additions, titanium compounds can be used, including, but not limited to, $TiB_2$ or TiC, or other titanium compounds known in the art. The amount added should be limited, as excess titanium additions can lead to insoluble second phase particles which are to be avoided.

More preferred amounts of the various compositional elements of the above alloy composition include the following: magnesium present in an amount ranging from about 0.6-1.1 wt %; silver present in an amount ranging from about 0.2-0.7 wt %; and zinc present in an amount ranging up to about 0.6 wt %. Alternatively, zinc can be partially substituted for silver, with a combined amount of zinc and silver up to about 0.8-0.9 wt %.

Dispersoid additions or recrystallization inhibitor additions can be made to the alloy to control the evolution of grain structure during hot working operations such as hot rolling, extrusion, or forging. One dispersoid addition can be zirconium, which forms $Al_3Zr$ particles that inhibit recrystallization. Manganese can also be added, to replace zirconium or in addition to zirconium so as to provide a combination of two dispersoid forming elements that allow improved grain structure control in the final product. Manganese is known to increase the second phase content of the final product which can have a detrimental impact on fracture toughness; hence the level of additions made will be controlled to optimize alloy properties.

Preferably, zirconium will be present in an amount ranging up to about 0.18 wt %; manganese will more preferably be present in an amount ranging up to about 0.6 wt %, most preferably about 0.3-0.6 wt %. Also preferably, manganese will be present from about 0.20 to 0.40 wt %. The final product form will influence the preferred range for the selected dispersoid additions.

Other dispersoid additions or recrystallization inhibitors may also be used, including Cr, Sc, Hf and Er, to replace or supplement the zirconium or manganese. For example, the aluminum-based alloy of the present invention may further comprise scandium, which can be added as a dispersoid or grain refining element to control grain size and grain structure. When present, scandium will be added in an amount ranging up to about 0.25 wt %, more preferably up to about 0.18 wt %.

Other elements that can be added during casting operations include, but are not limited to beryllium and calcium. These elements are used to control or limit oxidation of the molten aluminum. These elements are regarded as trace elements with additions typically less than about 0.01 wt %, with preferred additions less than about 100 ppm.

The alloys of the present invention have preferred ranges of other elements that are typically viewed as impurities and are maintained within specified ranges. Most common of these impurity elements are iron and silicon, and where high levels of damage tolerance are required (as in aerospace products) the Fe and Si levels are preferably kept relatively low to limit the formation of the constituent phases $Al_7Cu_2Fe$ and $Mg_2Si$ which are detrimental to fracture toughness and fatigue crack growth resistance. These phases have low solid solubility in Al-alloy and once formed cannot be eliminated by thermal treatments. Additions of Fe and Si are maintained at less than about 0.5 wt % each. Preferably these are kept below a combined maximum level of less than about 0.25 wt %, with a more preferred combined maximum of less than about 0.2 wt % for aerospace products. Other incidental elements/impurities could include sodium, chromium or nickel, for example.

In an additional aspect, the invention provides a wrought or cast product made from an aluminum-based alloy consisting essentially of about 3.0-4.0 wt % copper; about 0.4-1.1 wt % magnesium; up to about 0.8 wt % silver; up to about 1.0 wt % Zn; up to about 0.25 wt % Zr; up to about 0.9 wt % Mn; up to about 0.5 wt % Fe; and up to about 0.5 wt % Si; the balance substantially aluminum, incidental impurities and elements, said copper and magnesium present in a ratio of about 3.6-5 parts copper to about 1 part magnesium. Preferably, the copper and magnesium are present in a ratio of about 4-4.5 parts copper to about 1 part magnesium. Also preferably, the wrought or cast product made from the aluminum-based alloy is substantially vanadium free. Additional preferred embodiments are those as described above for the alloy composition.

As used herein, the term "wrought product" refers to any wrought product as that term is understood in the art, including, but not limited to, rolled products such as forgings, extrusions, including rod and bar, and the like. A preferred category of wrought product is an aerospace wrought product, such as sheet or plate used in aircraft fuselage or wing manufacturing, or other wrought forms suitable for use in aerospace applications, as that term would be understood by one skilled in the art. Preferably, the aerospace wrought products include fuselage applications, including skin, panels, and stringers, or for use in wing applications, including lower wing skins, stringers, and panels, and in thick component applications such as spars and ribs. Alternatively, an alloy of the present invention may be used in any of the above-mentioned wrought forms in other products, such as products for other industries including automotive and other transportation applications, recreation/sports, and other uses. In addition, the inventive alloy may also be used as a casting alloy, as that term is understood in the art, where a shape is produced.

In an additional aspect, the present invention provides a matrix or metal matrix composite product, made from the alloy composition described above.

In accordance with the invention, a preferred alloy is made into an ingot-derived product suitable for hot working or rolling. For instance, large ingots of the aforesaid composition can be semicontinuously cast, then scalped or machined to remove surface imperfections as needed or required to provide a good rolling surface. The ingot may then be preheated to homogenize and solutionize its interior structure. A suitable preheat treatment is to heat the ingot to about 900-980° F. It is preferred that homogenization be conducted at cumulative hold times on the order of about 12 to 24 hours.

The ingot is then hot rolled to achieve a desired product dimensions. Hot rolling should be initiated when the ingot is at a temperature substantially above about 850° F., for instance around 900-950° F. For some products, it is preferred to conduct such rolling without reheating, i.e., using the power of the rolling mill to maintain rolling temperatures above a desired minimum. Hot rolling is then continued, normally in a reversing hot mill, until the desired thickness of end plate product is achieved.

In accordance with this invention, the desired thickness of hot rolled plate for lower wing skin applications is generally between about 0.35 to 2.2 inches or so, and preferably within about 0.9 to 2 inches. Aluminum Association guidelines define sheet products as less than 0.25 inches in thickness; products above 0.25 inches are defined as plate.

In addition to the preferred embodiments of this invention for lower wing skin and spar webs, other applications of this alloy may include stringer extrusions. When making an extrusion, an alloy of the present invention is first heated to between about 650-800° F., preferably about 675-775° F. and includes a reduction in cross-sectional area (or extrusion ratio) of at least about 10:1.

Hot rolled plate or other wrought product forms of this invention are preferably solution heat treated (SHT) at one or more temperatures between about 900° F. to 980° F. with the objective to take substantial portions, preferably all or substantially all, of the soluble magnesium and copper into solution, it being again understood that with physical processes which are not always perfect, probably every last vestige of these main alloying ingredients may not be fully dissolved during the SHT (or solutionizing) step(s). After heating to the elevated temperatures described above, the plate product of this invention should be rapidly cooled or quenched to complete solution heat treating. Such cooling is typically accomplished by immersion in a suitably sized tank of water or by using water sprays, although air chilling may be used as supplementary or substitute cooling means.

After quenching, this product can be either cold worked and/or stretched to develop adequate strength, relieve internal stresses and straighten the product. Cold deformation (for example, cold rolling, cold compression) levels can be up to around 11% with a preferred range of about 8 to 10%. The subsequent stretching of this cold worked product will be up to a maximum of about 2%. In the absence of cold rolling the product may be stretched up to a maximum of about 8% with a preferred level of stretch in the 1 to 3% range.

After rapid quenching, and cold working if desired, the product is artificially aged by heating to an appropriate temperature to improve strength and other properties. In one preferred thermal aging treatment, the precipitation hardenable plate alloy product is subjected to one aging step, phase or treatment. It is generally known that ramping up to and/or down from a given or target treatment temperature, in itself, can produce precipitation (aging) effects which can, and often need to be, taken into account by integrating such ramping conditions and their precipitation hardening effects into the total aging treatment. Such integration is described in greater detail in U.S. Pat. No. 3,645,804 to Ponchel. With ramping and its corresponding integration, two or three phases for thermally treating the product according to the aging practice may be effected in a single, programmable furnace for convenience purposes; however, each stage (step or phase) will be more fully described as a distinct operation. Artificial aging treatments can use a single principal aging stage such as up to 375° F. with aging treatments in a preferred range of 290 to 330° F. Aging times can range up to 48 hours with a preferred range of about 16 to 36 hours as determined by the artificial aging temperature.

A temper designation system has been developed by the Aluminum Association and is in common usage to describe the basic sequence of steps used to produce different tempers. In this system the T3 temper is described as solution heat treated, cold worked and naturally aged to a substantially stable condition, where cold work used is recognized to affect mechanical property limits. The T6 designation includes products that are solution heat treated and artificially aged, with little or no cold work such that the cold work is not thought to affect mechanical property limits. The T8 temper designates products that are solution heat treated, cold worked and artificially aged, where the cold work is understood to affect mechanical property limits.

Preferably, the product is a T6 or T8 type temper, including any of the T6 or T8 series. Other suitable tempers include, but are not limited to, T3, T39, T351, and other tempers in the T3X series. It is also possible that the product be supplied in a T3X temper and be subjected to a deformation or forming process by an aircraft manufacturer to produce a structural component. After such an operation the product may be used in the T3X temper or aged to a T8X temper.

Age forming can provide a lower manufacturing cost while allowing more complex wing shapes to be formed. During age forming, the part is constrained in a die at an elevated temperature, usually between about 250° F. and about 400° F., for several to tens of hours, and desired contours are accomplished through stress relaxation. If a higher temperature artificial aging treatment is to be used, such as a treatment above 280° F., the metal can be formed or deformed into a desired shape during the artificial aging treatment. In general, most deformations contemplated are relatively simple, such as a very mild curvature across the width and/or length of a plate member.

In general, plate material is heated to about 300° F.-400° F., for instance around 310° F., and is placed upon a convex form and loaded by clamping or load application at opposite edges of the plate. The plate more or less assumes the contour of the form over a relatively brief period of time but upon cooling springs back a little when the force or load is removed. The curvature or contour of the form is slightly exaggerated with respect to the desired forming of the plate to compensate for springback. If desired, a low temperature artificial aging treatment step at around 250° F. can precede and/or follow age forming. Alternatively, age forming can be performed at a temperature such as about 250° F., before or after aging at a higher temperature such as about 330° F. One skilled in the art can determine the appropriate order and temperatures of each step, based on the properties desired and the nature of the end product.

The plate member can be machined after any step, for instance, such as by tapering the plate such that the portion intended to be closer to the fuselage is thicker and the portion closest to the wing tip is thinner. Additional machining or other shaping operations, if desired, can also be performed either before or after the age forming treatment.

Prior art lower wing cover material for the last few generations of modern commercial jetliners has been generally from the 2×24 alloy family in the naturally aged tempers such as T351 or T39, and thermal exposure during age forming is minimized to retain the desirable material characteristics of naturally aged tempers. In contrast, alloys of the present invention are used preferably in the artificially aged tempers, such as T6 and T8-type tempers, and the artificial aging treatment can be simultaneously accomplished during age forming without causing any degradation to its desirable properties. The ability of the invention alloy to accomplish desired contours during age forming is either equal to or better than the currently used 2×24 alloys.

EXAMPLE

In preparing inventive alloy compositions to illustrate the improvement in mechanical properties, ingots of 6×16 inch cross-section were Direct Chill (D.C.) cast for the Sample A to D compositions defined in Tables 1 and 2. After casting, the ingots were scalped to about 5.5 inch thickness in preparation for homogenization and hot rolling. The ingots were batch homogenized using a multi-step practice with a final step of soaking at about 955 to 965° F. for 24 hours. The ingots were given an initial hot rolling to an intermediate slab gage and then reheated at about 940° F. to complete the hot rolling operation, reheating was used when hot rolling temperatures fell below about 700° F. The samples were hot rolled to about 0.75 inches for the plate material and about 0.18 inches for sheet. After hot rolling the sheet samples were cold rolled about 30% to finish at about 0.125 inches in gage.

Samples of the fabricated plate and sheet were then heat treated, at temperatures in the range of about 955 to 965° F. using soak times of up to 60 minutes, and then cold water quenched. The plate samples were stretched within one hour of the quench to a nominal level of about 2.2%. The sheet samples were also stretched within one hour of the quench with a nominal level of about 1% used. Samples of the plate and sheet were allowed to naturally age after stretching for about 72 hours before being artificially aged. Samples were artificially aged for between 24 and 32 hours at about 310° F. The sample plates and sheets were then characterized for mechanical properties including tensile, fracture toughness and fatigue crack growth resistance.

Tables 1 and 2 show sheet and plate products made from compositions of the present invention as compared with prior art compositions.

TABLE 1

Chemical Analyses for Plate Material

| Al—Cu—Mg—Ag (Plate) Alloy | Composition | | | | | | | | |
|---|---|---|---|---|---|---|---|---|---|
| | Cu wt % | Mg wt % | Ag Wt % | Zn wt % | Mn wt % | V wt % | Zr wt % | Si Wt % | Fe Wt % |
| Sample F (per Karabin) | 5 | 0.8 | 0.55 | 0 | 0.6 | 0 | 0.13 | 0.06 | 0.07 |
| Sample E (per Cassada) | 4.5 | 0.7 | 0.5 | <0.05 | 0.3 | <0.05 | 0.11 | 0.04 | 0.06 |
| Sample D | 4.9 | 0.8 | 0.48 | <0.05 | 0.3 | <0.05 | 0.11 | 0.02 | 0.01 |
| Sample C | 4.7 | 1.0 | 0.51 | <0.05 | 0.3 | <0.05 | 0.11 | 0.06 | 0.03 |
| Sample B | 3.6 | 0.8 | 0.48 | <0.05 | 0.3 | <0.05 | 0.09 | 0.03 | 0.02 |
| Sample A | 3.6 | 0.9 | 0.48 | <0.05 | 0.3 | <0.05 | 0.12 | 0.02 | 0.03 |
| 2X24HDT (Commercial Alloy) | 3.8-4.3 | 1.2-1.63 | <0.05 | <0.05 | 0.45-0.7 | <0.05 | <0.05 | | |
| 2324 (Commercial Alloy) | 3.8-4.4 | 1.2-1.8 | <0.05 | <0.05 | 0.30-0.9 | <0.05 | <0.05 | | |

TABLE 2

Chemical Analyses for Sheet Material

| Al—Cu—Mg—Ag (Sheet) Alloy | Composition | | | | | | | | |
|---|---|---|---|---|---|---|---|---|---|
| | Cu wt % | Mg wt % | Ag wt % | Zn wt % | Mn wt % | V wt % | Zr wt % | Fe wt % | Si wt % |
| Sample F (per Karabin) | 5 | 0.8 | 0.55 | 0 | 0.6 | 0 | 0.13 | 0.07 | 0.06 |
| Sample E (per Cassada) | 4.5 | 0.7 | .5 | <0.05 | 0.3 | <0.05 | <0.11 | 0.06 | 0.04 |
| Sample D | 4.9 | 0.8 | 0.48 | <0.05 | 0.3 | <0.05 | <0.11 | 0.01 | 0.02 |
| Sample C | 4.7 | 1.0 | 0.51 | <0.05 | 0.3 | <0.05 | <0.11 | 0.03 | 0.06 |
| Sample B | 3.6 | 0.8 | 0.48 | <0.05 | 0.3 | <0.05 | <0.09 | 0.02 | 0.03 |
| Sample A | 3.6 | 0.9 | 0.48 | <0.05 | 0.3 | <0.05 | <0.12 | 0.03 | 0.02 |
| 2524 (Commercial Alloy) | 4.0-4.5 | 1.2-1.6 | <0.05 | <0.05 | 0.45-0.7 | <0.05 | <0.05 | | |

Fatigue Crack Growth Resistance

An important property to airframe designers is resistance to cracking by fatigue. Fatigue cracking occurs as a result of repeated loading and unloading cycles, or cycling between a high and a low load such as when a wing moves up and down or a fuselage swells with pressurization and contracts with depressurization. The loads during fatigue are below the static ultimate or tensile strength of the material measured in a tensile test and they are typically below the yield strength of the material. If a crack or crack-like defect exists in a structure, repeated cyclic or fatigue loading can cause the crack to grow. This is referred to as fatigue crack propagation. Propagation of a crack by fatigue may lead to a crack large enough to propagate catastrophically when the combination of crack size and loads are sufficient to exceed the material's fracture toughness. Thus, an increase in the resistance of a material to crack propagation by fatigue offers substantial benefits to aerostructure longevity. The slower a crack propagates, the better. A rapidly propagating crack in an airplane structural member can lead to catastrophic failure without adequate time for detection, whereas a slowly propagating crack allows time for detection and corrective action or repair.

The rate at which a crack in a material propagates during cyclic loading is influenced by the length of the crack. Another important factor is the difference between the maximum and the minimum loads between which the structure is cycled. One measurement which takes into account both the crack length and the difference between maximum and minimum loads is called the cyclic stress intensity factor range or $\Delta K$, having units of ksi$\sqrt{in}$, similar to the stress intensity factor used to measure fracture toughness. The stress intensity factor range ($\Delta K$) is the difference between the stress intensity factors at the maximum and minimum loads. Another measure of fatigue crack propagation is the ratio between the minimum and maximum loads during cycling, called the stress ratio and denoted by R, where a ratio of 0.1 means that the maximum load is 10 times the minimum load.

The crack growth rate can be calculated for a given increment of crack extension by dividing the change in crack length (called Δa) by the number of loading cycles (ΔN) which resulted in that amount of crack growth. The crack propagation rate is represented by Δa/ΔN or 'da/dN' and has units of inches/cycle. The fatigue crack propagation rates of a material can be determined from a center cracked tension panel.

Under spectrum loading conditions the results are sometimes reported as the number of simulated flights to cause final failure of the test specimen but is more often reported as the number of flights necessary to grow the crack over a given increment of crack extension, the latter sometimes representing a structurally-significant length such as the initial inspectable crack length.

Specimen dimensions for the Constant Amplitude FCG performance testing of sheet were 4.0 inches wide by 12 inches in length by full sheet thickness. Spectrum tests were performed using a specimen of the same dimensions using a typical fuselage spectrum and the number of flights and the results presented in Table 3. As can be seen in Table 3, over a crack length interval from 8 to 35 mm the spectrum life can be increased by over 50% with the new alloy. The spectrum FCG tests were performed in the L-T orientation.

TABLE 3

Typical Spectrum FCG data for sheet material tested in the L-T orientation

| Alloy | Flights at a = 8.0 mm | Flights from a = 8 to 35 mm |
|---|---|---|
| A2524-T3 | 14,068 | 37,824 |
| Sample E-T8 (per Cassada) | 11,564 | 29,378 |
| Sample A-T8 | 24,200 | 56,911 |
| % improvement of Sample A-T8 over 2524-T3 | 72% | 50% |

Figure 2:
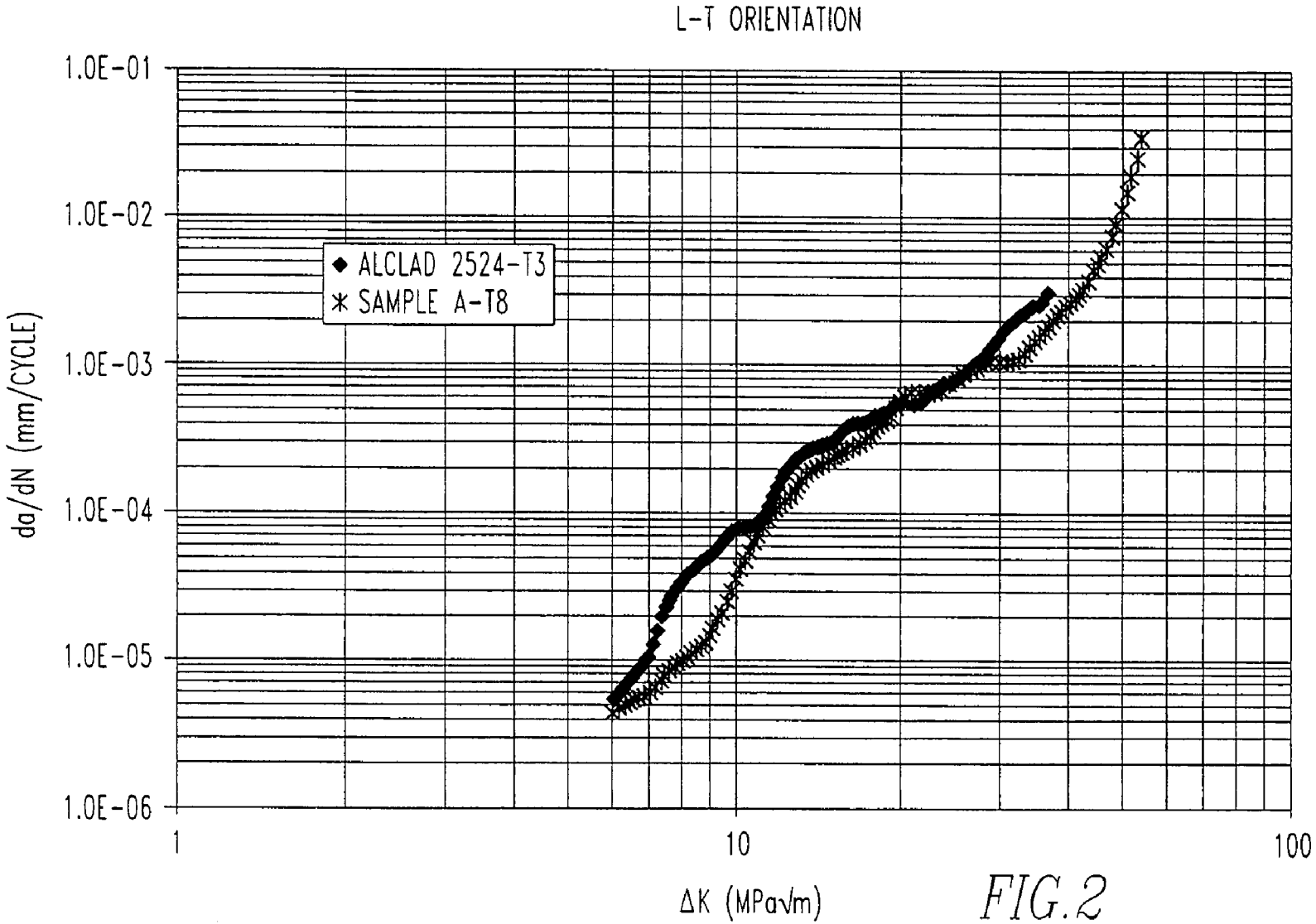
FIG. 2 is a graph showing constant amplitude FCG data for 2524-T3 and Sample A-T8 sheet. Tests were conducted in the L-T orientation with R ratio equals 0.1.

The new alloy was also tested under constant amplitude FCG conditions for both L-T and T-L orientations at R=0.1 (FIGS. 1 and 2). The T-L orientation is usually the most critical for a fuselage application but in some areas such as the fuselage crown (top) over the wings, the L-T orientation becomes the most critical.

Improved performance is measured by having lower crack growth rates at a given ΔK value. For all values tested, the new alloy shows an enhanced performance over 2524-T3. FCG data is typically plotted on log-log scales which tend to minimize the degree of difference between the alloys. However, for a given ΔK value, the improvement of alloy Sample A can be quantified as shown in Table 4 (FIG. 1):

TABLE 4

Constant Amplitude FCG data for sheet material tested in the T-L orientation

| Alloy | ΔK (MPa/m) | FCG Rate (mm/cycle) | % Decrease in FCG Rate (Sample vs.2524) |
|---|---|---|---|
| 2524-T3 | 10 | 1.1E−04 | — |
| Sample A-T8 | 10 | 3.8E−05 | 65% |
| 2524-T3 | 20 | 6.5E−04 | — |
| Sample A-T8 | 20 | 4.6E−04 | 29% |
| 2524-T3 | 30 | 2.5E−03 | — |
| Sample A-T8 | 30 | 1.1E−03 | 56% |

Note:
lower values of FCG rate are an indication of improved performance

The invention alloy was also tested in the plate form under both Constant Amplitude (CA), for Sample A, and spectrum loading (Samples A and B). Specimen dimensions for the CA tests were the same as those for sheet, except that the specimens were machined to a thickness of 0.25 inches from the mid-thickness (T/2) location by equal metal removal from both plate surfaces. For the spectrum tests, the specimen dimensions were 7.9 inches wide by 0.47 inches thick also from the mid-thickness (T/2) location. All tests were performed in the L-T orientation since this orientation corresponds to the principal direction of tension loading during flight.

Figure 3:
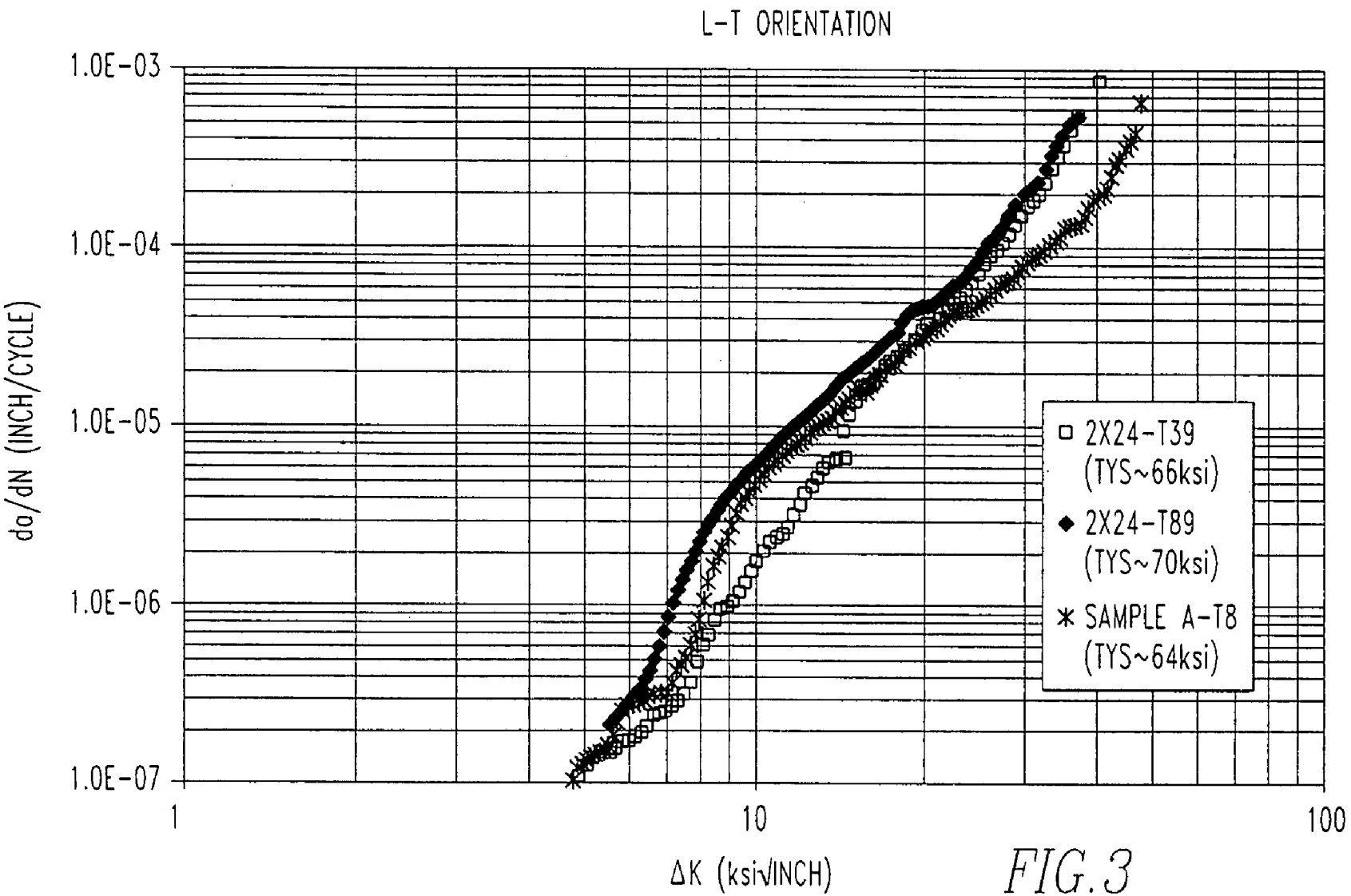
FIG. 3 is a graph showing constant amplitude FCG data for 2×24HDT-T39, 2×24HDT-T89, and Sample A plate. Tests were conducted in the L-T orientation with R ratio equals 0.1.

As can be seen in FIG. 3, under CA loading the inventive alloy has faster FCG rates, particularly in the lower ΔK regime, than the high damage tolerant alloy composition 2×24HDT in the T39 temper. When the 2×24HDT alloy is artificially aged to the T89 temper it exhibits degradation in CA fatigue crack growth performance which is typical of 2×24 alloys. This is a principal reason the T39 and lower strength T351 tempers are almost exclusively used in lower wing application even though artificially aged tempers such as the T89, T851 or T87 offer many advantages such as ability to age form to the final temper and better corrosion resistance. The inventive alloy, even though in an artificially aged condition, has superior FCG resistance than 2×24HDT-T89 at all ΔK, while exceeding the performance of 2×24HDT in the high damage tolerant T39 temper at higher ΔK.

Figure 4:
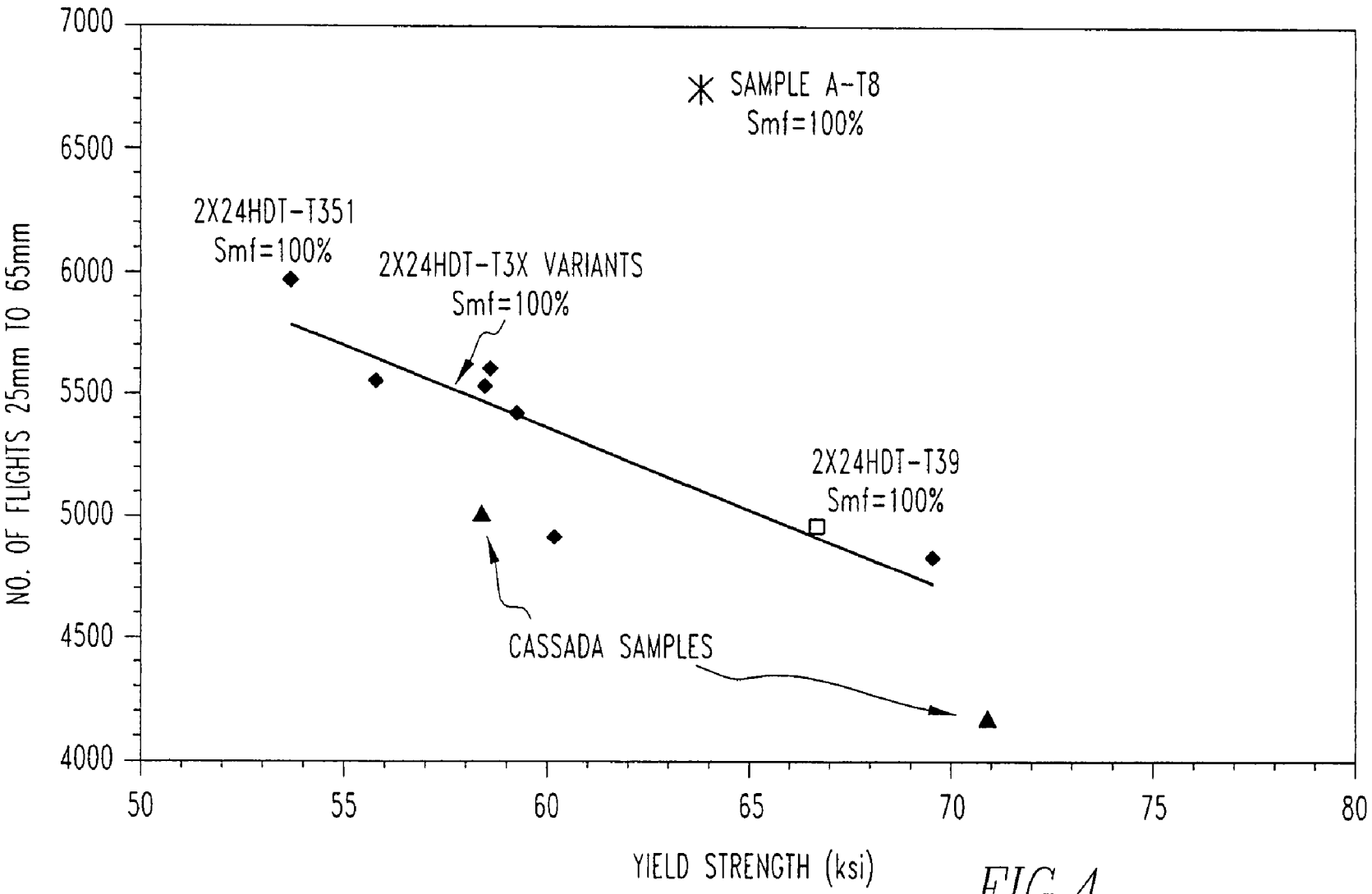
FIG. 4 is a graph showing comparison data of spectrum lives as a function of yield stress (by alloy/temper) for Sample A and Sample B plate and 2×24HDT.

The lower ΔK regime in fatigue crack growth is significant as this is where the majority of structural life is expected to occur. Based on the superior CA performance of 2×24HDT in the T39 temper and similar yield strength it would be expected that it would be superior to Sample A under spectrum loading. Surprisingly, however, when tested under a typical lower wing spectrum, Sample A performed significantly better than 2×24HDT-T39, exhibiting a 36% longer life (FIG. 4, Table 5). This result could not have been predicted by one skilled in the art. More surprisingly, the spectrum performance of Sample A was superior to that of 2×24HDT in the T351 temper which has similar constant amplitude FCG resistance to 2×24HDT-39 but significantly lower yield strength than either 2×24HDT-T39 or Sample A. The superior spectrum performance of the inventive alloy is also shown by the data on Sample B (Table 5 and FIG. 4).

Those skilled in the art recognize that lower yield strength is beneficial to spectrum performance as further illustrated by the trend line in FIG. 4 for 2×24HDT processed to T3X tempers having a range of strength levels. The spectrum life of Samples A and B lie clearly above this trend line for 2×24HDT and also are clearly superior to the compositions of Cassada which lie below the trend line for 2×24HDT.

TABLE 5

Typical Spectrum FCG data for plate material tested in the L-T orientation

| Alloy | L TYS (ksi) | # of Flights (a = 25 to 65 mm) | Life Improvement of Sample A over 2x24-T39 (%) |
|---|---|---|---|
| 2X24HDT-T39 | 66 | 4952 | — |
| 2X24HDT-T351 | 54 | 5967 | 20% |
| Sample E (per Cassada) | 58 | 5007 | 1% |
| Sample E (per Cassada) | 71 | 4174 | −16% |
| Sample D-T8 (per Karabin) | 75 | 4859 | −2% |
| Sample C-T8 | 76 | 4877 | −2% |

TABLE 5-continued

| Alloy | L TYS (ksi) | # of Flights (a = 25 to 65 mm) | Life Improvement of Sample A over 2x24-T39 (%) |
|---|---|---|---|
| | Typical Spectrum FCG data for plate material tested in the L-T orientation | | |
| Sample B-T8 | 62 | 6287 | 27% |
| Sample A-T8 | 64 | 6745 | 36% |

Fracture Toughness

The fracture toughness of an alloy is a measure of its resistance to rapid fracture with a preexisting crack or crack-like flaw present. Fracture toughness is an important property to airframe designers, particularly if good toughness can be combined with good strength. By way of comparison, the tensile strength, or ability to sustain load without fracturing, of a structural component under a tensile load can be defined as the load divided by the area of the smallest section of the component perpendicular to the tensile load (net section stress). For a simple, straight-sided structure, the strength of the section is readily related to the breaking or tensile strength of a smooth tensile coupon. This is how tension testing is done. However, for a structure containing a crack or crack-like defect, the strength of a structural component depends on the length of the crack, the geometry of the structural component, and a property of the material known as the fracture toughness. Fracture toughness can be thought of as the resistance of a material to the harmful or even catastrophic propagation of a crack under a tensile load.

Fracture toughness can be measured in several ways. One way is to load in tension a test coupon containing a crack. The load required to fracture the test coupon divided by its net section area (the cross-sectional area less the area containing the crack) is known as the residual strength with units of thousands of pounds force per unit area (ksi). When the strength of the material as well as the specimen are constant, the residual strength is a measure of the fracture toughness of the material. Because it is so dependent on strength and geometry, residual strength is usually used as a measure of fracture toughness when other methods are not as useful because of some constraint like size or shape of the available material.

When the geometry of a structural component is such that it doesn't deform plastically through the thickness when a tension load is applied (plane-strain deformation), fracture toughness is often measured as plane-strain fracture toughness, $K_{Ic}$. This normally applies to relatively thick products or sections, for instance 0.6 or 0.75 or 1 inch or more. ASTM E-399 has established a standard test using a fatigue pre-cracked compact tension specimen to measure $K_{Ic}$ which has the unit ksi$\sqrt{\text{in}}$. This test is usually used to measure fracture toughness when the material is thick because the test is believed to be independent of specimen geometry as long as appropriate standards for width, crack length and thickness are met. The symbol K, as used in $K_{Ic}$, is referred to as the stress intensity factor.

Structural components which deform by plane-strain are relatively thick as indicated above. Thinner structural components (less than 0.6 to 0.75 inch thick) usually deform under plane stress or more usually under a mixed mode condition. Measuring fracture toughness under this condition can introduce additional variables because the number which results from the test depends to some extent on the geometry of the test coupon. One test method is to apply a continuously increasing load to a rectangular test coupon containing a crack. A plot of stress intensity versus crack extension known as an R-curve (crack resistance curve) can be obtained this way. R-curve determination is set forth in ASTM E561.

When the geometry of the alloy product or structural component is such that it permits deformation plastically through its thickness when a tension load is applied, fracture toughness is often measured as plane-stress fracture toughness. The fracture toughness measure uses the maximum load generated on a relatively thin, wide pre-cracked specimen. When the crack length at the maximum load is used to calculate the stress-intensity factor at that load, the stress-intensity factor is referred to as plane-stress fracture toughness $K_c$. When the stress-intensity factor is calculated using the crack length before the load is applied, however, the result of the calculation is known as the apparent fracture toughness, $K_{app}$, of the material. Because the crack length in the calculation of $K_c$ is usually longer, values for $K_c$ are usually higher than $K_{app}$ for a given material. Both of these measures of fracture toughness are expressed in the unit ksi$\sqrt{\text{in}}$. For tough materials, the numerical values generated by such tests generally increase as the width of the specimen increases or its thickness decreases.

It is to be appreciated that the width of the test panel used in a toughness test can have a substantial influence on the stress intensity measured in the test. A given material may exhibit a $K_{app}$ toughness of 60 ksi$\sqrt{\text{in}}$ using a 6-inch wide test specimen, whereas for wider specimens, the measured $K_{app}$ will increase with the width of the specimen. For instance, the same material that had a 60 ksi$\sqrt{\text{in}}$ $K_{app}$ toughness with a 6-inch panel could exhibit higher $K_{app}$ values, for instance around 90 ksi$\sqrt{\text{in}}$ with a 16-inch panel, around 150 ksi$\sqrt{\text{in}}$ with a 48-inch wide panel and around 180 ksi$\sqrt{\text{in}}$ with a 60-inch wide panel. To a lesser extent, the measured $K_{app}$ value is influenced by the initial crack length (i.e., specimen crack length) prior to testing. One skilled in the art will recognize that direct comparison of K values is not possible unless similar testing procedures are used, taking into account the size of the test panel, the length and location of the initial crack, and other variables that influence the measured value.

Fracture toughness data have been generated using a 16-inch M(T) specimen. All K values for toughness in the following tables were derived from testing with a 16-inch wide panel and a nominal initial crack length of 4.0 inches. All testing was carried out in accordance with ASTM E561 and ASTM B646.

Figure 5:
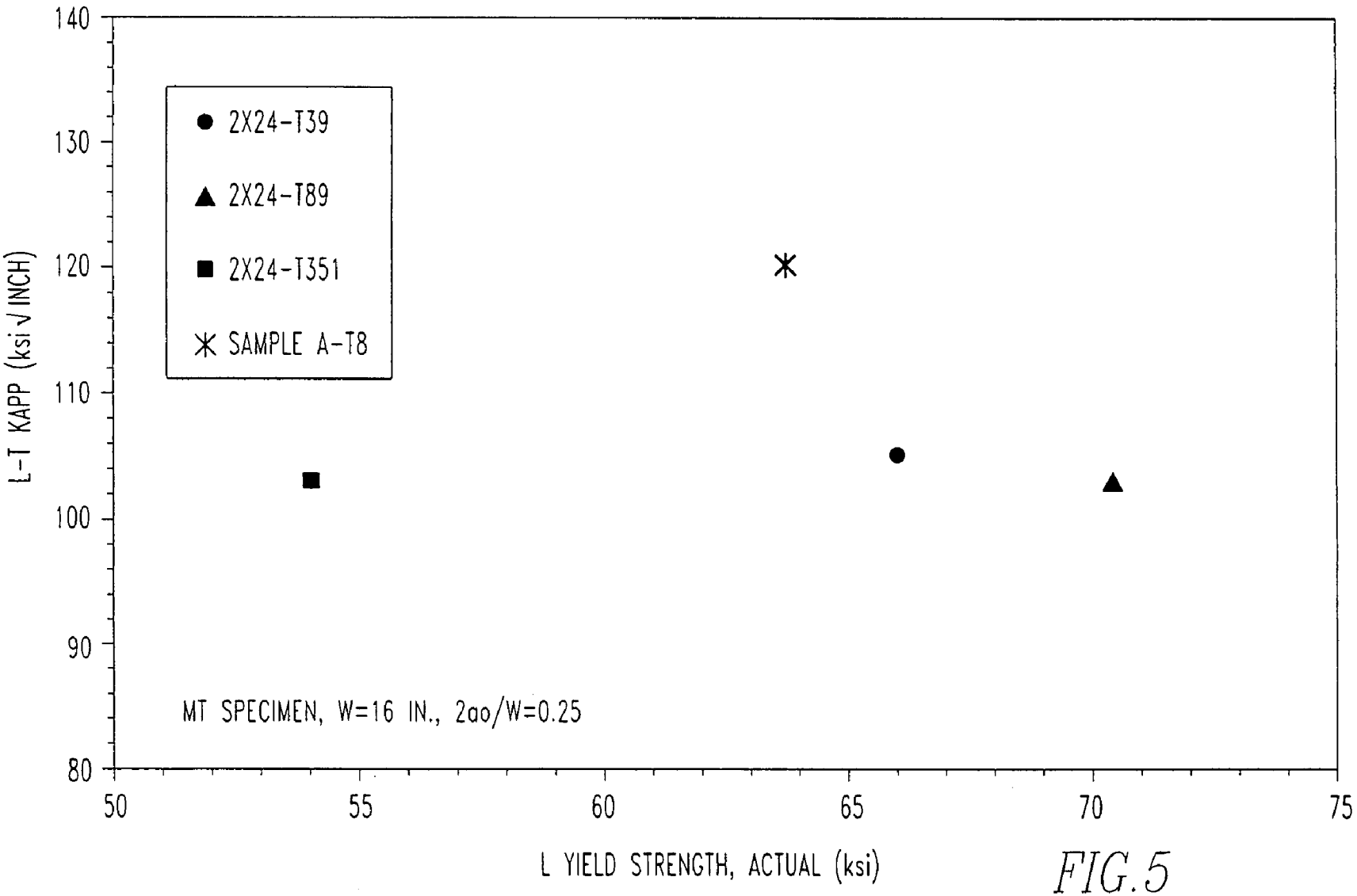
FIG. 5 is a graph showing a comparison of fracture toughness as a function of yield stress (by alloy/temper) for Sample A and Sample B plate and 2×24HDT.

As can be seen in Table 6 and FIG. 5, the new alloy (Samples A and B) has a significantly higher toughness (measured by $K_{app}$) when compared to comparable strength alloys in the T3 temper. Thus, an alloy of the present invention can sustain a larger crack than a comparative alloy such as 2324-T39 in both thick and thin sections without failing by rapid fracture.

Alloy 2×24HDT-T39 has a typical yield strength (TYS) of ~66 ksi and a $K_{app}$ value of 105 ksi$\sqrt{\text{in}}$, while the new alloy has a slightly lower TYS of ~64 ksi (3.5% lower) but a toughness $K_{app}$ value of 120 ksi$\sqrt{\text{in}}$ (12.5% higher). It can also be seen that when aged to a T8 temper, the 2×24HDT product shows a strength increase TYS ~70 ksi with a $K_{app}$ value of 103 ksi$\sqrt{\text{in}}$. In sheet form, an alloy of the present invention also exhibits higher strength with high fracture toughness when compared to standard 2×24-T3 standard sheet products.

A complete comparison of the properties of alloys of the present invention and prior art alloys is shown in Tables 6, 7, 8 and 9.

TABLE 6

Typical Tensile and Fracture Toughness data for the Plate Material

| Al—Cu—Mg—Ag (Plate) Alloy | Temper | Tensile Properties TYS (Ksi) L | UTS (ksi) L | E (%) L | Fracture Toughness Kapp (ksi$\sqrt{in}$) L-T | KC (ksi$\sqrt{in}$) L-T |
|---|---|---|---|---|---|---|
| Sample F (per Karabin) | T8 | 68.7 | 75.3 | 13.0 | 106.6 | 148.4 |
| Sample E (per Cassada) | T8 | 70.9 | 76.3 | 13.5 | 114.0 | 166.0 |
| Sample D (per Karabin) | T8 | 75.6 | 78.9 | 12.0 | 109.0 | |
| Sample C | T8 | 74.6 | 78.1 | 11.5 | 113.0 | |
| Sample B | T8 | 61.8 | 67.8 | 17.5 | 117.0 | |
| Sample A | T8 | 63.8 | 70.1 | 16.5 | 120.0 | |
| 2X24HDT-T39 (Commercial Alloy) | T39 | 66.0 | 70.4 | 13.7 | 105.0 | 150.0 |
| 2X24HDT-T351 (Commercial Alloy) | T351 | 54.0 | 67.1 | 21.9 | 102.0 | 157.0 |
| 2324-T39 (Commercial Alloy) | T39 | 66.5 | 69.0 | 11.0 | 98.0 | |

TABLE 7

Typical Tensile Property data for the Sheet Material

| Al—Cu—Mg—Ag (Sheet) Alloy | Temper | Tensile Properties TYS (Ksi) LT | UTS (ksi) LT | E (%) LT |
|---|---|---|---|---|
| Sample F (per Karabin) | T8 | | | |
| Sample E (per Cassada) | T8 | 60.4 | 69.0 | 12.7 |
| Sample D (per Karabin) | T8 | 67.3 | 73.2 | 10.3 |
| Sample C | T8 | 67.9 | 74.4 | 11.0 |

TABLE 7-continued

Typical Tensile Property data for the Sheet Material

| Al—Cu—Mg—Ag (Sheet) Alloy | Temper | Tensile Properties TYS (Ksi) LT | UTS (ksi) LT | E (%) LT |
|---|---|---|---|---|
| Sample B | T8 | 52.7 | 62.4 | 15.3 |
| Sample A | T8 | 54.1 | 63.3 | 13.0 |
| 2524-T3 (Commercial Alloy) | T3 | 45.0 | 64.0 | 21.0 |

TABLE 8

Typical Constant Amplitude and Spectrum FCG results for the Plate Material

| Al—Cu—Mg—Ag (Plate) Alloy | Fatigue FCG Rate (da/dN) Delta K (ksi$\sqrt{in}$) @ 10-6 in/cycle (L-T) | Delta K (ksi$\sqrt{in}$) @ 10-5 in/cycle (L-T) | Delta K (ksi$\sqrt{in}$) @ 10-4 in/cycle (L-T) | Spectrum No of Flights at Smf = 100% |
|---|---|---|---|---|
| Sample F (per Karabin) | 7.3 | 11.9 | 23.4 | |
| Sample E (per Cassada) | 7.0 | 12.8 | 27.0 | |
| Sample D (per Karabin) | 7.2 | 13.1 | 29.7 | 4859 |
| Sample C | 7.4 | 13.3 | 28.7 | 4877 |
| Sample B | 8.1 | 13.8 | 31.3 | 6287 |
| Sample A | 8.0 | 12.8 | 32.9 | 6745 |
| 2X24HDT-T39 (Commercial Alloy) | 9.1 | 14.4 | 27.0 | 4952 |
| 2X24HDT-T351 (Commercial Alloy) | | 13.6 | | 5967 |
| 2324-T39 (Commercial Alloy) | 8.1 | 13.1 | 25.4 | — |

TABLE 9

Typical Constant Amplitude and Spectrum FCG results for the Sheet Material

| Al—Cu—Mg—Ag (Sheet) Alloy | Fatigue: FCG Rate (da/dN)*: Delta K (ksi/in) @ 10-6 in/cycle (T-L) | Delta K (ksi/in) @ 10-5 in/cycle (T-L) | Delta K (ksi/in) @ 10-6 in/cycle (T-L) | Spectrum: No of Flights at a = 8.0 mm | Spectrum: No of Flights at a = 8 to 35 mm |
|---|---|---|---|---|---|
| Sample D (per Karabin) | 6.8 | 14.4 | 35.7 | | |
| Sample C | 7.6 | 14.4 | 33.4 | | |
| Sample B | 8.1 | 13.3 | 37.2 | | |
| Sample A | 8.2 | 14.9 | 36.0 | 24200.0 | 56911.0 |
| 2524-T3 (Commercial Alloy) | 6.5 | 13.1 | 27.5 | 14068.0 | 37824.0 |

An alloy of the present invention exhibits improvements relative to 2324-T39 in both fatigue initiation resistance and fatigue crack growth resistance at low ΔK, which allows the threshold inspection interval to be increased. This improvement provides an advantage to aircraft manufacturers by increasing the time to a first inspection, thus reducing operating costs and aircraft downtime. An alloy of the present invention also exhibits improvements relative to 2324-T39 in fatigue crack growth resistance and fracture toughness, properties relevant to the repeat inspection cycle, which primarily depends on fatigue crack propagation resistance of an alloy at medium to high ΔK and the critical crack length which is determined by its fracture toughness. These improvements will allow an increase in the number of flight cycles between inspections. Due to the benefits provided by the present invention, aircraft manufacturers can also increase operating stress and reduce aircraft weight while maintaining the same inspection interval. The reduced weight may result in greater fuel efficiency, greater cargo and passenger capacity and/or greater aircraft range.

Additional Testing

Additional samples were prepared as follows: samples were cast into bookmolds of approximately 1.25×2.75 inch cross-section. After casting the ingots were scalped to about 1.1 inch thickness in preparation for homogenization and hot rolling. The ingots were batch homogenized using a multi-step practice with a final step of soaking at about 955 to 965° F. for 24 hours. The scalped ingots were then given a heat-to-roll practice at about 825° F. and hot rolled down to about 0.1 inches in thickness. Samples were heat-treated, at temperatures in the range of about 955 to 965° F. using soak times of up to 60 minutes, and then cold water quenched. The samples were stretched within one hour of the quench to a nominal level of about 2%, allowed to naturally age after stretching for about 96 hours before being artificially aged for between about 24 and 48 hours at about 310° F. The samples were then characterized for mechanical properties including tensile and the Kahn tear (toughness-indicator) test. Results are presented in Table 10.

As can be seen in Table 10, additions of zinc when made to the alloy either in addition to or as a partial substitution for silver can lead to higher toughness for equal strength. Table 10 illustrates the toughness of the alloy as measured by a sub-scale toughness indicator test (Kahn-tear test) under the guidelines of ASTM B871. The results of this test are expressed as Unit of Propagation Energy (UPE) in units of inch-lb/in$^2$, with a higher number being an indication of higher toughness. Sample 3 in Table 10 shows higher toughness when zinc is present as a partial substitute for silver as compared to equal strength for Sample 1 when silver alone is added. The addition of zinc with silver can lead to equal or lower toughness for the same strength (Samples 1 and 2 compared to Samples 4 and 5). Additions of zinc without any silver can result in toughness levels obtained when silver alone is added, however, these toughness indicator levels are obtained at much lower strength levels (Sample 1 compared with Samples 6 through 9). The optimum combination of strength and toughness can be achieved by a preferred combination of copper, magnesium, silver, and zinc.

TABLE 10

Chemical Analyses (in wt %) and typical tensile, and toughness indicator properties

| Alloy | Cu | Mg | Ag | Zn | TYS (ksi) | UTS (ksi) | El (%) | UPE (in-lb/in2) |
|---|---|---|---|---|---|---|---|---|
| Sample 1 | 4.5 | 0.8 | 0.5 | | 70 | 73 | 13 | 617 |
| Sample 2 | 4.5 | 0.8 | 0.5 | 0.2 | 69 | 73 | 12 | 548 |
| Sample 3 | 4.5 | 0.8 | 0.3 | 0.2 | 69 | 75 | 11 | 720 |
| Sample 4 | 3.5 | 0.8 | 0.5 | | 60 | 66 | 15 | 1251 |
| Sample 5 | 3.5 | 0.8 | 0.5 | 0.2 | 60 | 65 | 14 | 1176 |
| Sample 6 | 4.5 | 0.8 | | 0.35 | 55 | 65 | 16 | 786 |
| Sample 7 | 4.5 | 0.8 | | 0.58 | 60 | 68 | 14 | 619 |
| Sample 8 | 4.5 | 0.8 | | 0.92 | 58 | 67 | 14 | 574 |
| Sample 9 | 4.5 | 0.5 | | 0.91 | 55 | 63 | 13 | 704 |

In aircraft structure, there are numerous mechanical fasteners installed that allows the assembly of the fabricated materials into components. The fastened joints are usually a source of fatigue initiation and the performance of material in representative coupons with fasteners is a quantitative measure of alloy performance. One such test is the High Load Transfer (HLT) test that is representative of chord-wise joints in wingskin structure. In such tests alloys of the current invention were tested against the 2×24HDT product (Table 11). The invention alloy (Sample A) has an average fatigue life that is 100% improved over the baseline material.

TABLE 11

| Typical High Load Transfer (HLT) joint fatigue lives | | |
|---|---|---|
| Alloy | Average HLT fatigue life (6 tests per alloy) | Improvement |
| 2x24HDT | 55,748 cycles | |
| Sample A | 116, 894 cycles | 100% |

The Interaction of Silver and Zinc and its Effect on Alloy Properties

As described above, the presence of optimum amounts of zinc and silver either as combined additions or partial substitutions can produce an alloy with certain strength and toughness properties. The use of a precious metal, such as silver, as an alloying addition is preferably limited to minimize material cost while obtaining maximum benefit in material properties. As shown below, valuable combinations of strength, toughness and corrosion performance can be obtained with the present invention where a threshold of silver additions has been established to achieve desirable material properties. Note, in additional testing performed on the following examples, strength and toughness measurements were made as previously disclosed, while corrosion performance was assessed using a type-of-attack test per ASTM G110 guidelines with results reported that indicate the type and depth of attack after a specified amount of time in the corrosion environment. In this test, sheet samples, at a given thickness location, (t/10 or at t/2 where t is the original sheet thickness) are exposed to a corrosive environment. The standard exposure time in the ASTM test is 6 hours, however, additional exposure up to a total of 24 hours can also be used in the assessment of alloy performance. The type of attack is described as either: None (N), Pitting (P) or inter-granular (IG). The preferred condition is N, i.e. no observed attack. The next preferred observation would be that of P, with the presence of IG regarded as undesirable. After the exposure time is completed the samples are typically cross-sectioned for optical metallography where the depth of attack can be measured. This is typically obtained for a given number of sites and can be used to compare an average depth or maximum depth of attack.

The susceptibility of an alloy to corrosion attack, in particular to the presence of IG, is significant as this can influence the alloy performance under dynamic loading conditions such as S-N fatigue. IG corrosion sites act as crack initiation sites under cyclic loading, cracks which then propagate and cause fatigue failures. For example, in published comparisons of Alclad 2024, bare 2024, and bare 6013 sheet, it has been reported that for S-N fatigue tests in a corrosive environment, the 6013 material, which was most susceptible to IG attack, possessed the lowest fatigue lives.

An additional set of alloys was prepared as follows: samples were cast into bookmolds of approximately 1.25×2.75 inch cross-section. The compositions were selected to give a range of silver and zinc additions that had a constant combined atomic percentage level of these combined elements. Silicon and iron levels were maintained at 0.05 wt % or less for each element. The compositions are given in Table 12. After casting the ingots were scalped to about 1.1 inch thickness in preparation for homogenization and hot rolling. The ingots were batch homogenized using a multi-step practice with a final step of soaking at about 955 to 965° F. for 24 hrs. The scalped ingots were then given a heat-to-roll practice at about 825° F. and hot rolled down to about 0.1 inch in thickness. Samples were heat-treated, at temperatures in the range of about 955 to 965° F. using soak times of up to 60 minutes, and then cold water quenched. The samples were stretched within one hour of the quench to a nominal level of about 2%, allowed to naturally age after stretching for about 96 hours before being artificially aged for between about 24 and 48 hours at about 310° F.

TABLE 12

| Alloy Compositions in wt % (or atomic % where stated) | | | | | | | | | |
|---|---|---|---|---|---|---|---|---|---|
| Alloy | Cu | Mg | Mn | Zr | Ag | Zn | Zn (atomic %) | Ag (atomic %) | Zn + Ag (atomic %) |
| Sample 1 | 3.7 | 0.89 | 0.31 | 0.10 | 0.00 | 0.29 | 0.12 | 0.00 | 0.12 |
| Sample 2 | 3.67 | 0.9 | 0.32 | 0.10 | 0.02 | 0.28 | 0.12 | 0.01 | 0.12 |
| Sample 3 | 3.67 | 0.9 | 0.32 | 0.10 | 0.1 | 0.24 | 0.10 | 0.03 | 0.13 |
| Sample 4 | 3.73 | 0.91 | 0.32 | 0.10 | 0.18 | 0.21 | 0.09 | 0.05 | 0.14 |
| Sample 5 | 3.63 | 0.9 | 0.32 | 0.10 | 0.23 | 0.18 | 0.08 | 0.06 | 0.14 |
| Sample 6 | 3.68 | 0.89 | 0.31 | 0.10 | 0.32 | 0.12 | 0.05 | 0.08 | 0.13 |
| Sample 7 | 3.71 | 0.91 | 0.33 | 0.10 | 0.48 | 0.01 | 0.00 | 0.12 | 0.13 |

Figure 6:
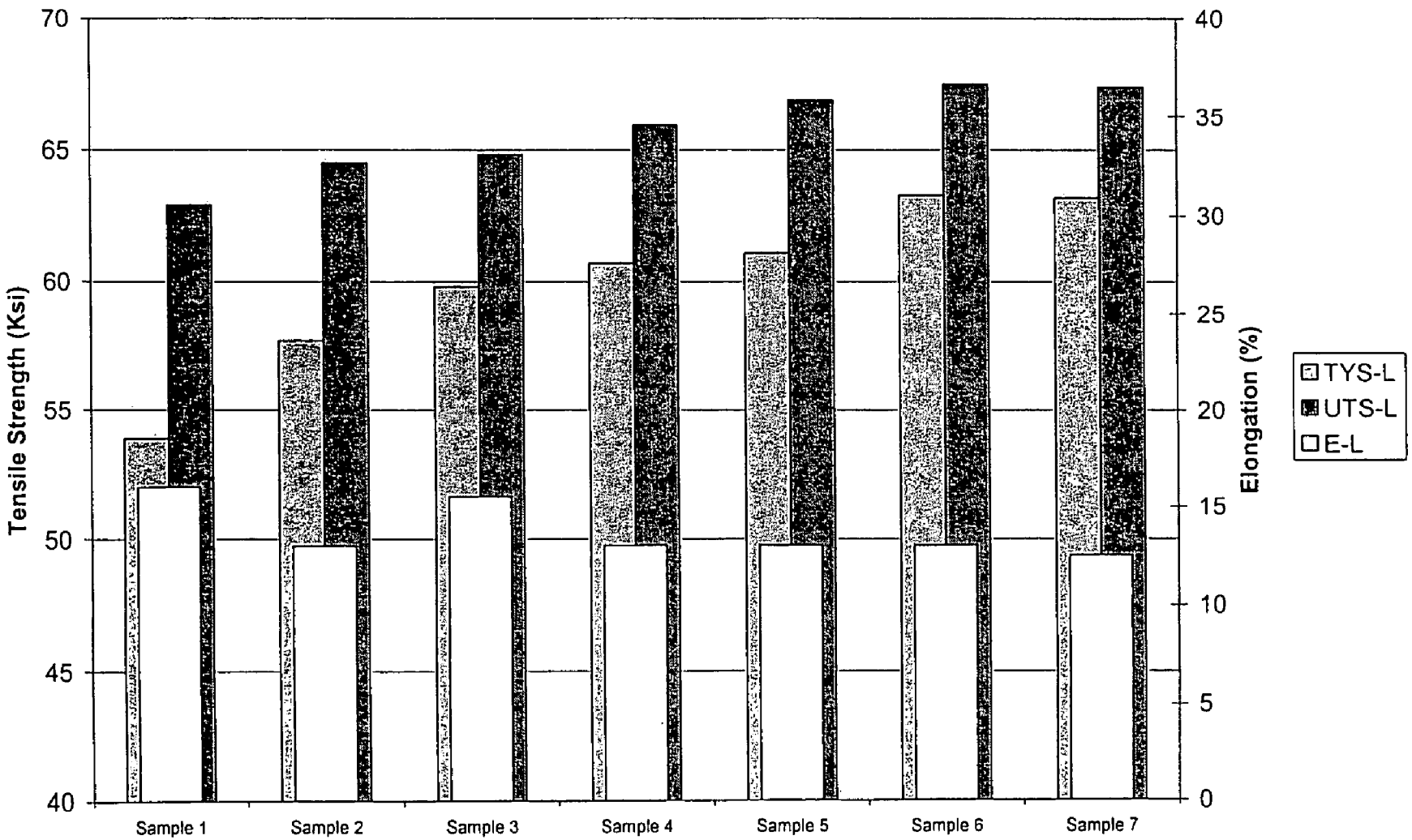
FIG. 6 is a graph showing the effect of zinc and silver content on tensile properties (tensile yield strength, ultimate tensile strength, and elongation) in the L orientation.
Figure 7:
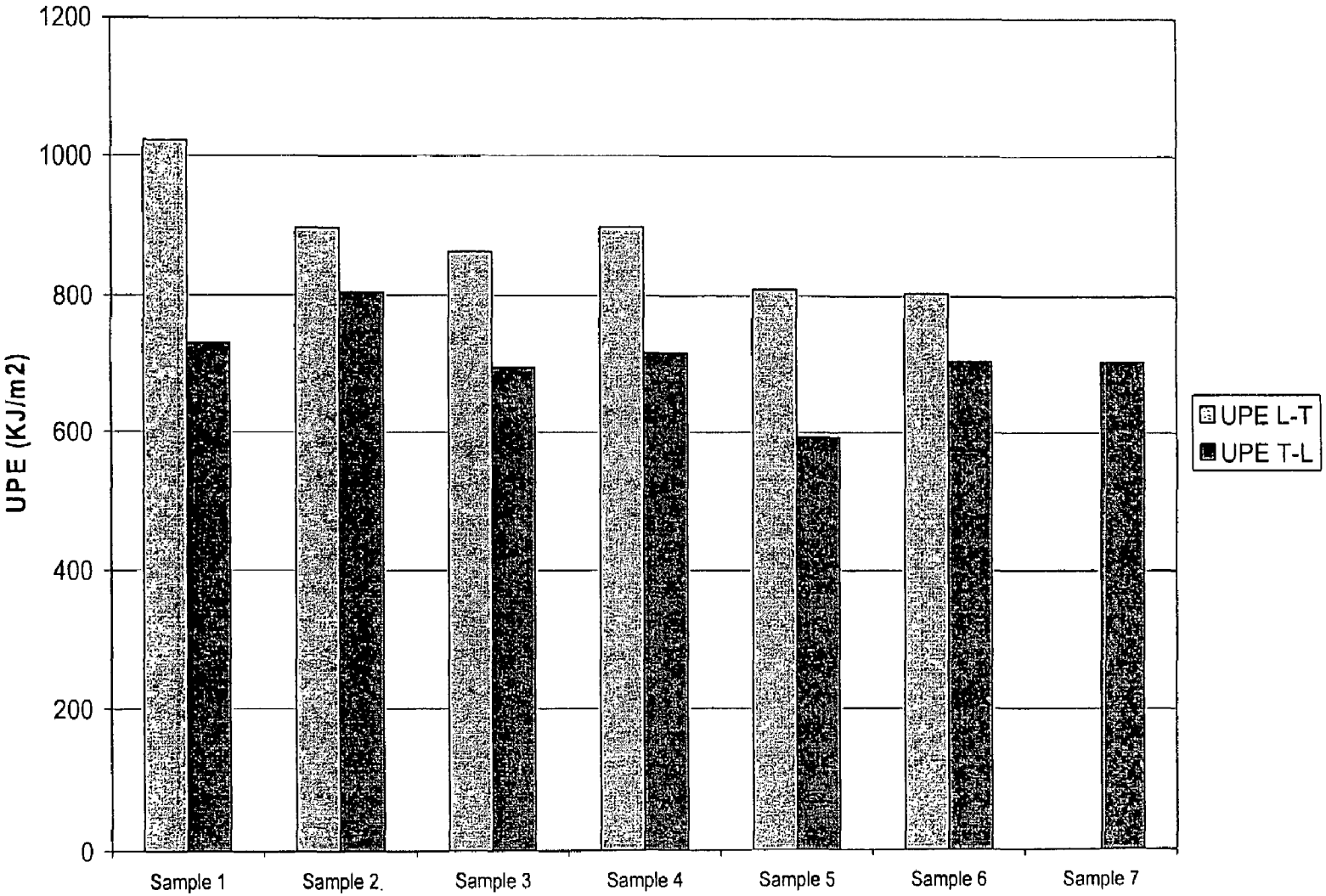
FIG. 7 is a graph showing the effect of silver and zinc content on unit propagation energy.
Figure 8:
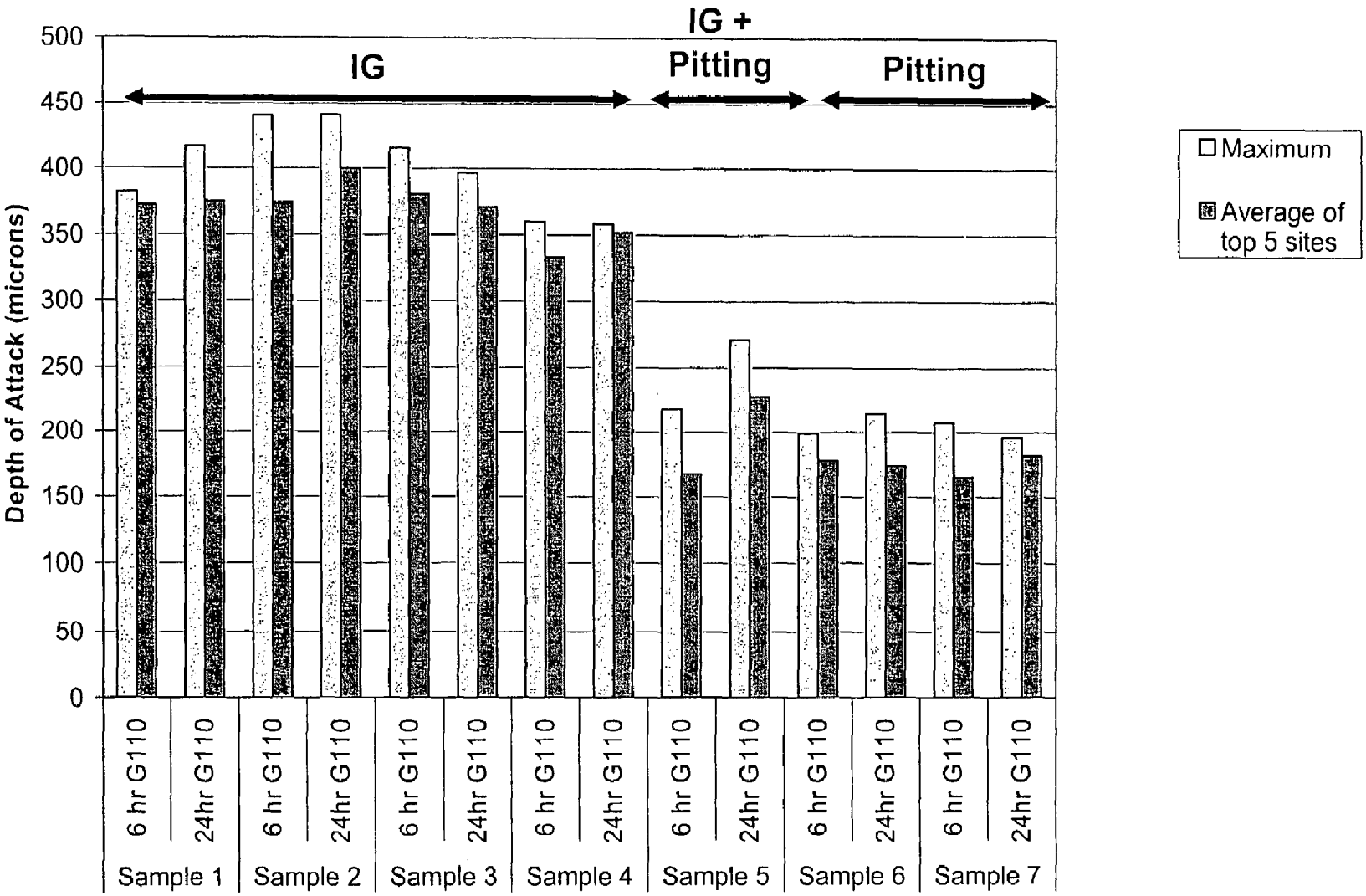
FIG. 8 is a graph showing the effect of silver and zinc content on the depth of corrosion attack/mode of attack measured per ASTM G110.

The tensile and UPE properties are shown in Table 13 (and also in FIGS. 6 and 7) for all the alloys. It is apparent that when an alloy has zinc but no silver is present (Sample 1) the tensile yield strength (TYS) is about 54 ksi and that when even a trace amount of silver is added at the 0.02 wt % level (Sample 2) an immediate increase in tensile yield strength of about 4 ksi is obtained. Further increases in TYS are obtained with further additions of silver. The UPE values indicate that with the addition of silver there is a general trend of reduced toughness as a function of the increasing strength. It can also be seen that at silver additions of 0.3 wt % and higher (Samples 6 and 7) there is limited change in strength and toughness. Another surprising benefit of the silver addition is seen when the corrosion results are studied (Table 14). In alloys with limited silver additions (Samples 1 through 5) there is evidence seen of IG attack, with higher levels of silver additions (Samples 6 and 7) there is a clear benefit of pitting attack with much lower depth of attack values (FIG. 8). Again it is seen from FIG. 8 that silver additions of about 0.3 wt % are sufficient to impart the improved corrosion resistance performance.

TABLE 13

| Alloy | TYS (ksi) | UTS (ksi) | E1 (%) | UPE (in-lb/in$^2$) |
|---|---|---|---|---|
| | Longitudinal tensile properties and L-T toughness indicator (UPE) properties. | | | |
| Sample 1 | 53.9 | 62.9 | 16.0 | 1021 |
| Sample 2 | 57.7 | 64.4 | 13.0 | 899 |
| Sample 3 | 59.8 | 64.7 | 15.5 | 864 |
| Sample 4 | 60.6 | 65.8 | 13.0 | 900 |
| Sample 5 | 61.1 | 66.8 | 13.0 | 810 |
| Sample 6 | 63.2 | 67.4 | 13.0 | 804 |
| Sample 7 | 63.5 | 67.4 | 12.5 | No data |

TABLE 14

Type-of-attack corrosion properties (per ASTM G110)

| Alloy | Maximum depth after 6 hours (microns) | Average of top five sites after 6 hours (microns) | Maximum depth after 24 hours (microns) | Average of top five sites after 24 hours (microns) | Corrosion Mode of Attack |
|---|---|---|---|---|---|
| Sample 1 | 382 | 372 | 416 | 375 | IG |
| Sample 2 | 440 | 374 | 441 | 400 | IG |
| Sample 3 | 415 | 381 | 397 | 370 | IG |
| Sample 4 | 360 | 333 | 359 | 352 | IG |
| Sample 5 | 218 | 168 | 271 | 228 | IG + P |
| Sample 6 | 199 | 178 | 214 | 174 | P |
| Sample 7 | 208 | 165 | 196 | 182 | P |

All tests were conducted at the surface location of the sheet.

The optimum combination of strength, toughness, and corrosion resistance can be achieved by a preferred combination of copper, magnesium, silver, and zinc. There is a clear benefit to strength in even trace levels of silver additions providing significantly higher values. A level of silver about 0.3 wt % can be seen to provide an excellent combination of strength, toughness and corrosion properties.

Figure 9:
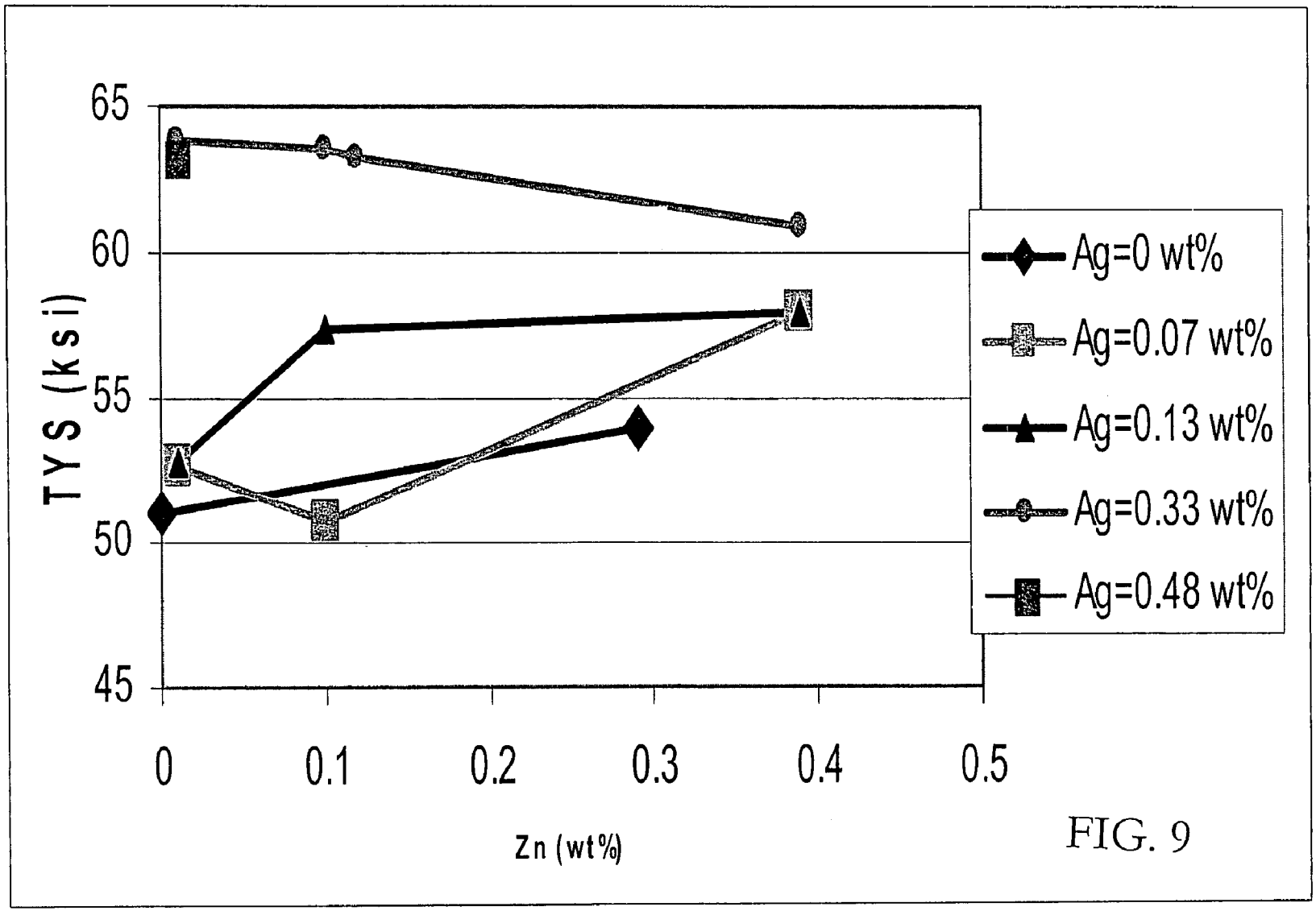
FIG. 9 is a graph charting tensile yield strength (TYS) as a function of silver and zinc content.
Figure 10:
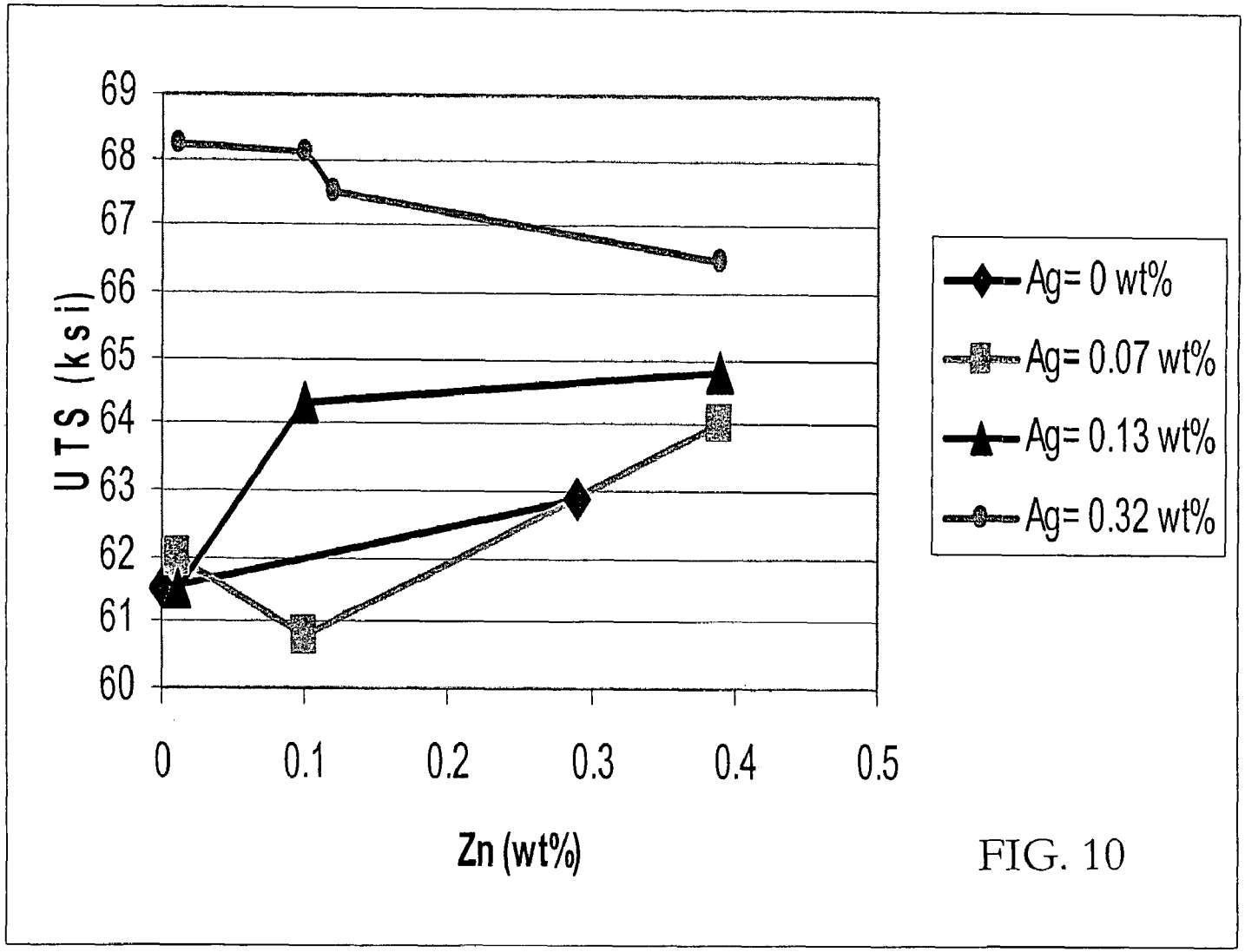
FIG. 10 is a graph charting ultimate tensile strength (UTS) as a function of silver and zinc content.
Figure 11:
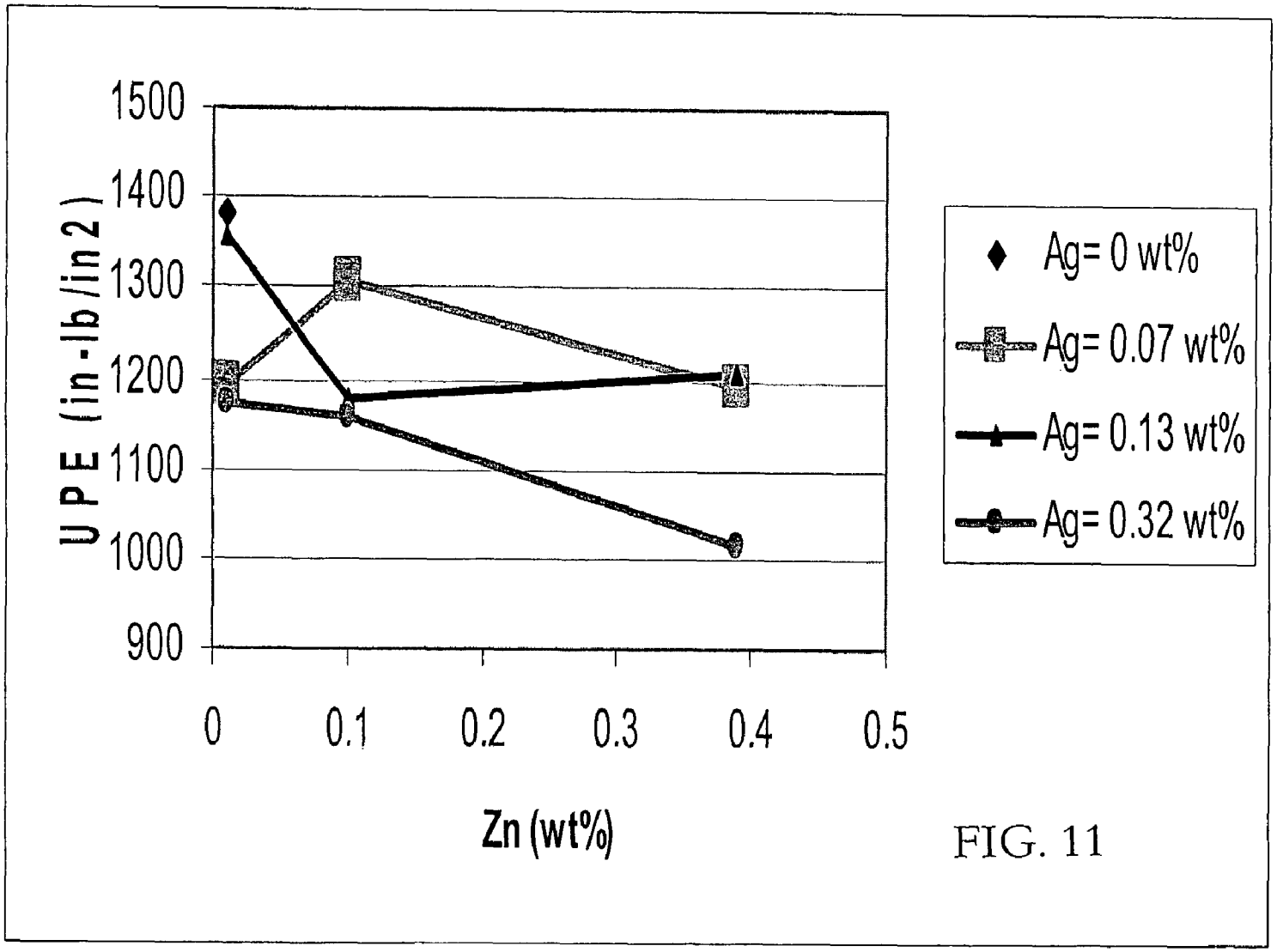
FIG. 11 is a graph charting toughness (UPE) as a function of silver and zinc content.
Figure 12:
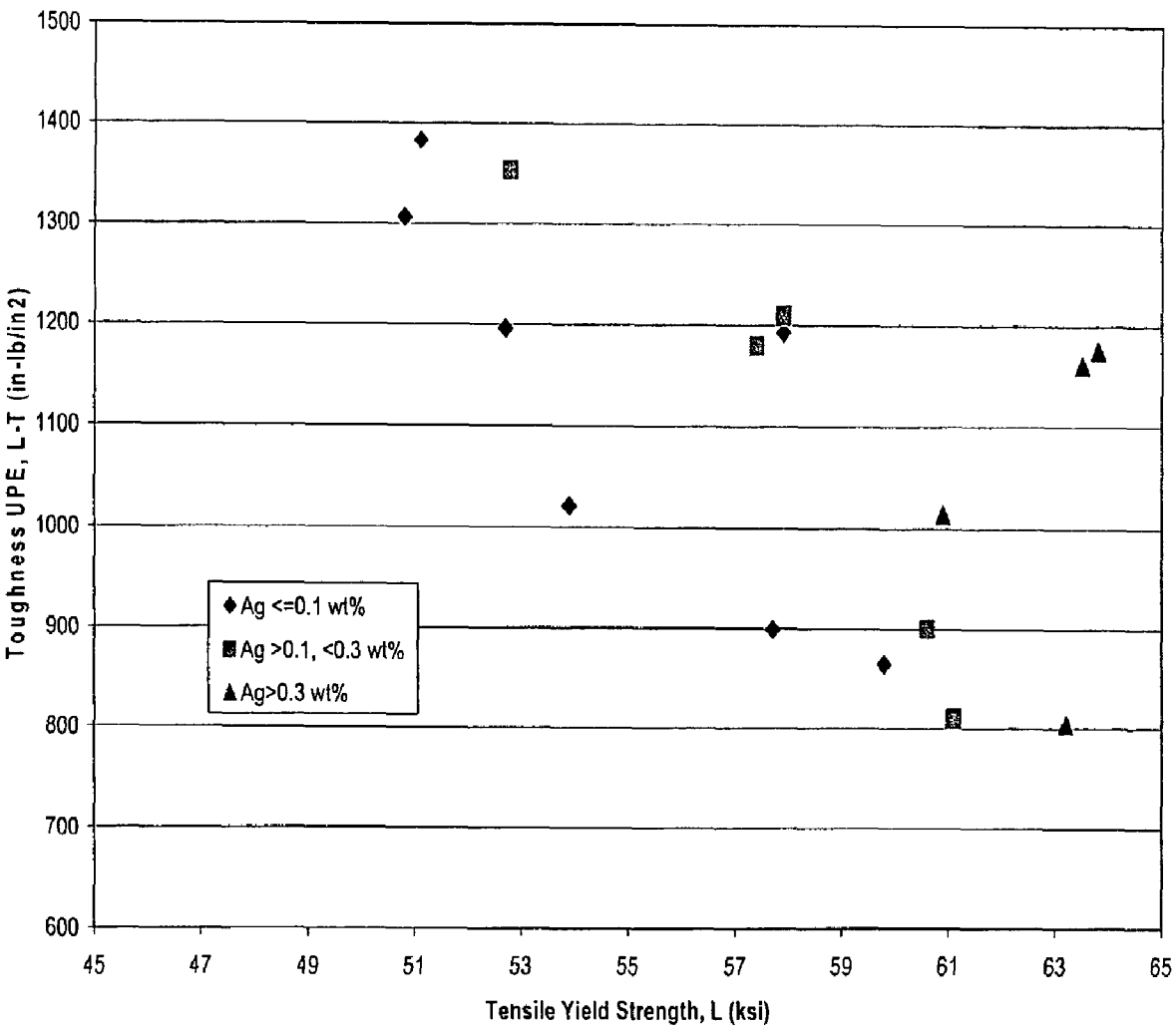
FIG. 12 is a graph depicting the effect of silver on the strength-toughness relationship.

In a further lab-scale study of the effect of silver and zinc on properties a second matrix of alloys were processed to examine the effect of zinc additions for three specific silver levels. Three nominal levels of zinc were studied for each targeted silver level. The nominal zinc levels were: 0.01, 0.1, and 0.4 wt %; the nominal silver levels were: 0.05, 0.1, and 0.3 wt %. A baseline alloy without any silver or zinc additions was also cast as a control (Sample 17). For each composition bookmold ingots were cast and processed to 0.1 inch sheet which were tested in both T3 and T8 tempers. All processing conditions were similar to those used above. Tensile, toughness (UPE) and corrosion (depth-of-attack) properties were measured in both the T3 and T8 conditions. The compositions cast are given in Table 15 in weight %. T8 temper tensile properties and UPE values are given in Table 16. FIGS. 9 and 10 show the T8 tensile strength response as a function of silver and zinc level. This figure includes data from both composition matrices (i.e. Samples 1 through 17). When the silver addition level is kept below 0.3 wt % there is a modest strength increase with increasing zinc. When silver is equal to or above 0.3 wt % there is a trend to slightly decreasing strength with increased zinc, however, all of the strength levels achieved at this silver level are above those with lower silver and show the high strengthening benefit achievable with the addition of silver. The impact on toughness (UPE) is shown in FIG. 11 as a function of silver and zinc level. With increasing zinc additions the toughness either remains similar or decreases independent of the silver level. When plotted as a strength-toughness relationship (FIG. 12) the beneficial influence of silver on strength with retained higher toughness levels becomes evident.

Figure 13:
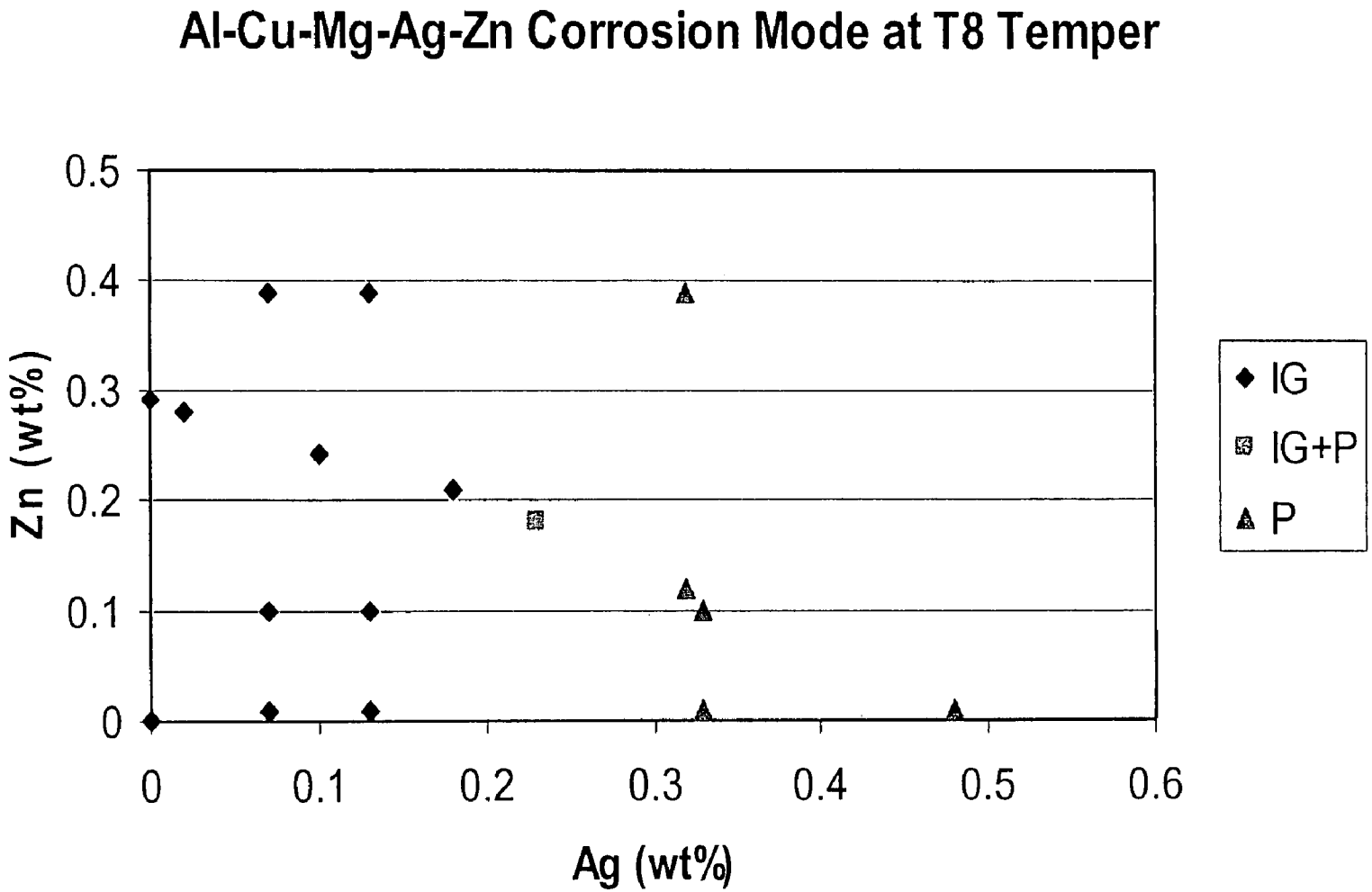
FIG. 13 is a graph charting the type of corrosion attack as a function of silver and zinc content.

In the T3 temper condition all of the samples showed a pitting response to the ASTM G110 test. In the T8 temper it was again seen that at silver levels of about 0.3 wt % there was a change to pitting (P) from the inter-granular (IG) attack seen at lower silver content. The benefit of silver on corrosion performance is also seen irrespective of the zinc addition level. The T8 corrosion results are in FIG. 13.

TABLE 15

Alloy compositions in wt %

| Alloy | Cu | Mg | Mn | Zr | Ag | Zn |
|---|---|---|---|---|---|---|
| Sample 8 | 3.70 | 0.91 | 0.32 | 0.12 | 0.0 | 0.0 |
| Sample 9 | 3.62 | 0.91 | 0.31 | 0.10 | 0.07 | 0.01 |
| Sample 10 | 3.63 | 0.92 | 0.32 | 0.10 | 0.07 | 0.10 |
| Sample 11 | 3.69 | 0.92 | 0.32 | 0.10 | 0.07 | 0.39 |
| Sample 12 | 3.67 | 0.91 | 0.31 | 0.10 | 0.13 | 0.01 |
| Sample 13 | 3.69 | 0.92 | 0.32 | 0.09 | 0.13 | 0.10 |
| Sample 14 | 3.68 | 0.92 | 0.33 | 0.09 | 0.13 | 0.39 |
| Sample 15 | 3.64 | 0.91 | 0.32 | 0.10 | 0.33 | 0.01 |
| Sample 16 | 3.63 | 0.91 | 0.32 | 0.10 | 0.33 | 0.10 |
| Sample 17 | 3.63 | 0.90 | 0.31 | 0.10 | 0.32 | 0.39 |

TABLE 16

T8 temper Longitudinal tensile properties and L-T toughness indicator (UPE) properties.

| Alloy | TYS (ksi) | UTS (ksi) | E1 (%) | UPE (in-lb/in$^2$) |
|---|---|---|---|---|
| Sample 8 | 51.1 | 61.5 | 18 | 1382 |
| Sample 9 | 52.7 | 62.0 | 17.0 | 1195 |
| Sample 10 | 50.8 | 60.8 | 17.3 | 1306 |
| Sample 11 | 57.9 | 64.0 | 13.0 | 1192 |
| Sample 12 | 52.8 | 61.5 | 16.7 | 1352 |
| Sample 13 | 57.4 | 64.3 | 14.3 | 1179 |
| Sample 14 | 57.9 | 64.8 | 14 | 1209 |
| Sample 15 | 63.8 | 68.2 | 12.7 | 1175 |
| Sample 16 | 63.5 | 68.1 | 13.7 | 1160 |
| Sample 17 | 60.9 | 66.5 | 11.7 | 1014 |

Effect of Cold Working and Aging on Properties

To further demonstrate the enhanced strength-toughness property combination of the inventive alloy over typical 2×24 alloys a study was made on the effect of cold working (e.g. stretching and cold rolling) and aging (such as natural or artificial aging) on material properties. Material was obtained from plant processed sheet for both Alclad 2524-T3 (an industry standard 2XXX aerospace fuselage material) and the inventive alloy. The inventive alloy had the nominal composition of 3.6 wt. % Cu, 0.9 wt. % Mg, 0.5 wt. % Ag, 0.5 wt. % Mn, 0.11 wt. % Zr, 0.05 wt. % Fe, and 0.03 wt. % Si, incidental elements and impurities, and the remainder aluminum. The Alclad 2524 sheet was produced using standard production practices and was received as 0.090 inches gauge material. The inventive alloy was cast as an ingot with a cross-section of 16×60 inches. The ingot was scalped and preheated using a multi-step practice with final soak in the range of 955 to 965 F. The ingot was hot rolled to a slab gauge of about 4 inches, the slab was reheated to a temperature in the range of 955 to 965 F. and then hot rolled to a final gauge of about 0.26 inches. The material was cold rolled to a final gauge of about 0.12 inches. Samples of both alloys were then prepared to laboratory processing; the 2524 material was to be re-solution heat treated for this study. The alloys were heat treated using the appropriate temperatures for each of their respective compositions, the sheet samples were all cold water quenched by immersion. Stretching was conducted within 1 hour of quenching and was targeted to achieve different levels. The 2524 samples were stretched to achieve: 0.75, 3, 6, and 9% stretch. The inventive alloy was stretched to achieve: 0.75, 3 and 6% stretch.

Figure 14:
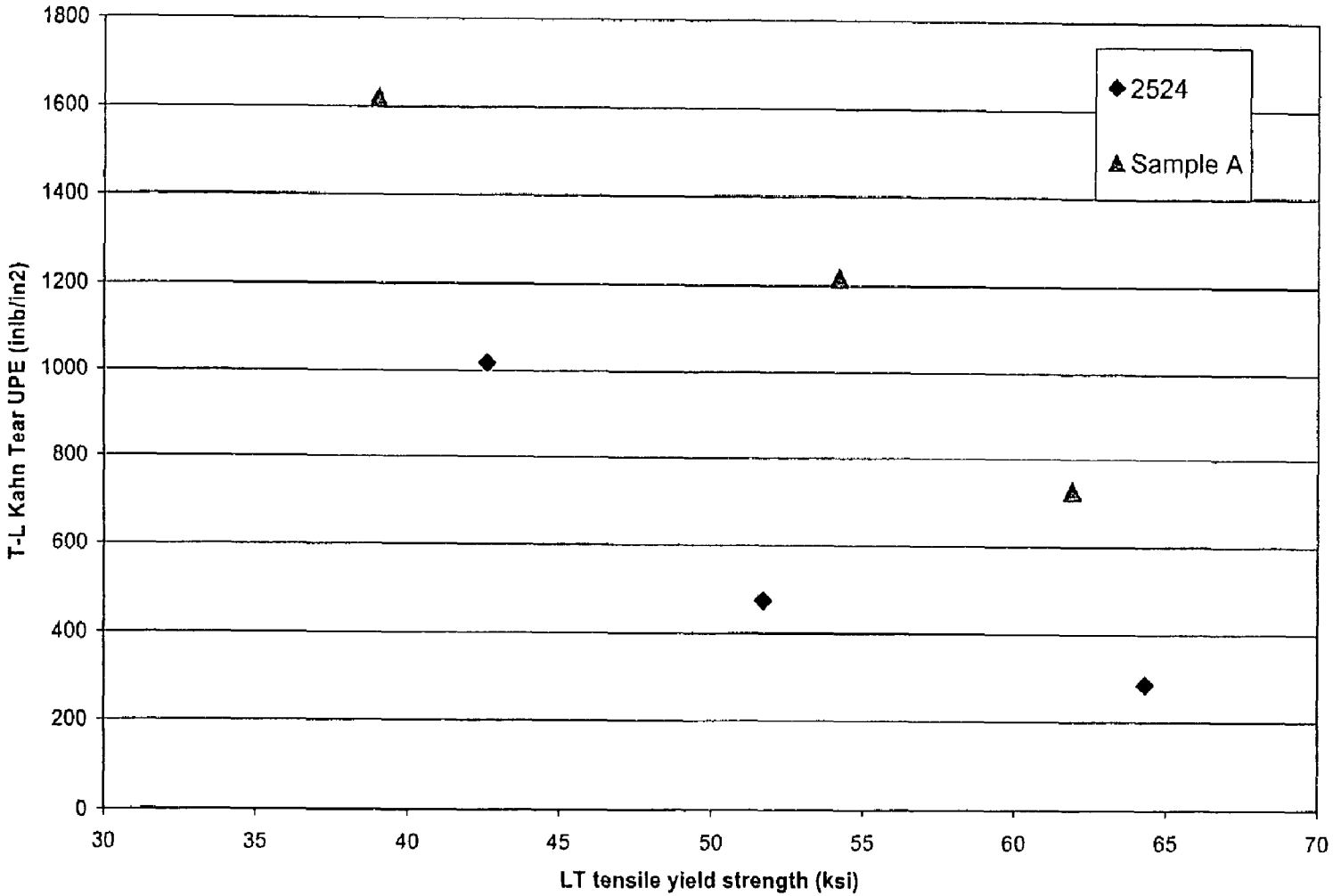
FIG. 14 is a graph charting the effect of cold work (stretch) and aging on the tensile properties of alloys of the present invention.

For each alloy a combination of stretch and aging (either at room or some elevated temperature) was used to generate variants with Long-Transverse (LT) tensile yield strengths ranging from around 40 to 60 ksi. For each strength level the Kahn Tear test was used to generate UPE values for the T-L orientation (UPE data are for the average of three tests per condition). All of the Kahn Tear tests were machined to the same thickness (0.064 inches) and three tests were run. The tensile and average UPE results are in Table 17 and FIG. 14 for alloys.

TABLE 17

Long-Transverse tensile properties and T-L Kahn Tear results

| Alloy | Stretch Level (%) | Aging time (hours) and temperature (F.) | TYS (ksi) | UTS (ksi) | El (%) | UPE (in-lb/in$^2$) |
|---|---|---|---|---|---|---|
| 2524-T3 | 0.75 | Naturally Aged | 42.6 | 63.2 | 26.0 | 1016 |
| 2524-T3 | 9 | Naturally Aged | 51.7 | 66.5 | 16.0 | 473 |
| 2524-T8 | 0.75 | 8 hrs at 325 F. | 64.3 | 69.0 | 10.0 | 284 |
| Sample A | 0.75 | 20 hrs at 310 F. | 39.0 | 58.6 | 30.0 | 1619 |
| Sample A | 3 | 20 hrs at 310 F. | 54.2 | 62.6 | 19.0 | 1217 |
| Sample A | 6 | 48 hrs at 310 F. | 61.9 | 66.8 | 15.0 | 726 |

As mentioned previously in the original patent application fracture toughness is often quoted as a single value: Kapp, Kc for example. In this case it should also be stated the panel size used to obtain this given value as it can vary as a function of the fracture toughness panel width. Fracture toughness has been measured on the same plant-processed material using a panel width of 16 inches (400 mm) in the T-L orientation. This data can be used as a reference point to the UPE values presented in Table 15 above. For the Sample A material the T-L K app value obtained was ~110 ksi$\sqrt{in}$ for material that had a LT tensile yield strength of ~57 ksi. By comparison similar tests conducted on 2524-T3 sheet can give a typical K app value of ~95 ksi$\sqrt{in}$ with LT tensile yield strengths of ~45 ksi. From this comparison the same ranking of higher toughness for the inventive alloy represented by Sample A can be observed.

In general it is known that the 2xxx family of alloys achieve a high level of toughness in the T3 temper and that this is reduced when the strength increases and/or the material is artificially aged. The inventive alloy has the ability to achieve high levels of toughness when in the artificially aged condition. The results from the current example show that for each equivalent strength level the inventive alloy clearly has higher toughness measured by the UPE value than the 2524 product. This enhanced toughness in the inventive alloy is maintained even when the 2524 material is in its preferred and more conventional T3 temper.

Weldability of the Alloy

With the increasing emphasis of reducing the manufacturing cost of aircraft structural members: the use of welding as a joining process to replace mechanical fastening is becoming more accepted. Traditionally welding has been regarded as a fusion process with the use of Gas Tungsten Arc (GTA) as an example of common practice. Within the range of non-heat treatable aluminum alloys available there are some (in the 3xxx, 5xxx family series) that are very compatible with these processes. Within the family of heat treated alloys (2xxx, 6xxx, and 7xxx) there are some that are amenable to welding but the majority of alloys have been shown not to be suitable for these joining processes. More recently welding technology has advanced to include a fusion process known as laser beam welding, and also a solid-state process known as Friction Stir Welding (FSW). In the case of FSW almost any alloy can be joined to obtain a reasonable level of weld strength and this process is being considered suitable for a number of alloys not traditionally considered as being "weldable". An assessment of weldability of an alloy can be made by measurement of tensile properties across a typical butt weld. The welded ultimate tensile strength is typically expressed as a percentage of the parent metal tensile strength to describe a "weld efficiency" of the material with a higher efficiency being a measure of the alloy's compatibility with the welding process. Alloy AA2024 is used extensively in aircraft structure in both the fuselage and wing structure. There are conflicting results in terms of weldability assessment reported in the art, which suggests that although this alloy can be welded it requires significant attention to control of the welding process parameters. Table 18 provides data on the weld properties of the inventive alloy compared to 2024. The inventive alloy is compatible with these joining techniques which can involve fission welding, such as, but not exclusively limited to laser beam, and also solid-state processes such as friction stir welding.

TABLE 18

Typical properties for laser welded 2024 and the Invention Alloy

| Alloy | Sheet thickness (mm) | Parent Metal UTS (MPa) | Weld UTS (MPa) | UTS Weld Efficiency (%) |
|---|---|---|---|---|
| 2024 [3] | 1.6 | 499 | 369 | 73.9 |
| Sample A | 2.5 | 482 | 340 | 75.4 |

Whereas particular embodiments of this invention have been described above for purposes of illustration, it will be evident to those skilled in the art that numerous variations of the details of the present invention may be made without departing from the invention as defined in the appended claims.

What is claimed is:

1. A 2xxx series alloy product having an effective combination of strength, toughness and corrosion resistance, an alloy consisting essentially of, Cu: about 3.0 to about 4.0 wt. %, Mg: about0.4to about 1.1 wt. %, Mn about 0.20 to about 0.9 wt %, combined weight percent of Fe and Si less than about 0.25 wt. %, Ag about 0.3 wt. % to about 0.8 wt. %

Zn up to about 0.40 wt. %, and up to about 0.1 wt. % of a grain refiner, the remainder aluminum and incidental elements and impurities, wherein the combined weight percent of Ag and Zn is at least about 0.3 wt.% and the Cu and the Mg are present in a ratio of about 3.6-4.5 parts Cu to about 1 part Mg.

2. The alloy product of claim 1, wherein the combined weight percent of Ag and Zn is at least about 0.4 wt. % and said ratio is about 4.0-4.5 parts Cu to 1.0 part Mg.

3. The alloy product of claim 1, wherein the weight percent Ag is from 0.30 to 0.50.

4. The alloy product of claim 1, further comprising a recrystallization inhibitor selected from the group consisting of Zr, Cr, Sc, Hf and Er.

5. The alloy product of claim 1, wherein said recrystallization inhibitor is up to about 0.18 wt % of Zr.

6. The alloy product of claim 1, wherein said grain refiner is a ceramic compound.

7. The alloy product of claim 1, wherein said grain refiner is titanium or a titanium compound.

8. The alloy product of claim 1, wherein said grain refiner is Ti, $TiB_2$ or TiC.

9. The alloy product of claim 1, wherein the weight percent of Ag is at least 0.4 wt. %.

10. The alloy product of claim 1, wherein the product is cold worked and artificially aged.

11. The alloy product of claim 1, wherein the product is aged to an under-aged strength.

12. The alloy product of claim 1, wherein the product is aged to peak strength.

13. The alloy product of claim 1, wherein the product is aged to over-aged strength.

14. An aluminum alloy suitable for use as a sheet product in fuselage applications including skin, panels, and stringers, or for use in wing applications including lower wing skins, stringers, and panels, and in thick components such as spars and ribs, an alloy consisting essentially of, copper from about 3.0 to about 4.0 wt. %, magnesium from about 0.4 to about 1.1 wt. %, manganese from about 0.2 to 0.4 wt. %, silver from about 0.2 to 0.8 wt. %, zinc from about 0.01 to 0.40 wt. %, up to about 0.20 wt. % of a recrystallization inhibitor, up to 0.10 wt % of a grain refiner selected from the group consisting essentially of Ti, $TiB_2$, and TiC, combined weight percent of Fe and Si less than about 0.25 wt. %, the remainder aluminum and incidental elements and impurities, wherein said Cu and Mg are present in a ratio of about 3.6-4.5 parts Cu to about 1 part Mg and wherein said alloy product has one or more mechanical properties or combinations of mechanical properties selected from the group consisting of 1) toughness as measured by the Kahn tear test using ASTM B871 of at least about 40% higher than AA2524 similarly tested and having about the same UTS and TYS;
2) toughness as measured by the Kahn tear test using ASTM B871 of at least about 20% higher than AA2524 similarly tested and at least about a 10% increase in UTS and TYS relative to AA2524;
3) an average high load transfer joint fatigue life at least about 60% greater than 2X24HDT in terms of average fatigue life (in cycles); and
4) a change in corrosion property type from intergranular to pitting as measured by ASTM G110.

15. The alloy product of claim 14, wherein the combined amount of Zn plus Ag is at least 0.3 wt. %.

16. The alloy product of claim 15, wherein the combined amount of Zn plus Ag is from about 0.3 wt. % to about 0.6 wt. %.

17. The alloy product of claim 14, wherein the combined weight percent of Ag and Zn is between about 0.3 and 1.2 wt. %.

18. The alloy product of claim 14, wherein the product is cold worked and artificially aged.

19. The alloy product of claim 14, wherein the product is aged to an under-aged strength.

20. The alloy product of claim 14, wherein the product is aged to peak strength.

21. The alloy product of claim 14, wherein the product is aged to over-aged strength.

22. The alloy product of claim 14, wherein the product is stretched or cold compressed to at least 2 wt. %.

23. The alloy product of claim 14, wherein the product is stretched or cold compressed at least 0.50%.

24. The alloy product of claim 14, further comprising a recrystallization inhibitor selected from the group consisting of Zr, Cr, Sc, Hf and Er.

* * * * *

UNITED STATES PATENT AND TRADEMARK OFFICE

CERTIFICATE OF CORRECTION

PATENT NO. : 7,449,073 B2
APPLICATION NO. : 11/220424
DATED : November 11, 2008
INVENTOR(S) : Jen C. Lin et al.

It is certified that error appears in the above-identified patent and that said Letters Patent is hereby corrected as shown below:

In column 23, line 42, after "T-L" , delete "K app" and insert --Kapp--.

In column 24, line 53, line 6 of Claim 1, after the second occurrence of "about", delete "0.9" and insert --0.40--.

In column 25, line 4, line 1 of claim 5, after "claim", delete "1" and insert --4--.

Signed and Sealed this

Twentieth Day of January, 2009

JON W. DUDAS
*Director of the United States Patent and Trademark Office*